US010087542B2

(12) United States Patent
Askin et al.

(10) Patent No.: US 10,087,542 B2
(45) Date of Patent: Oct. 2, 2018

(54) ANODIZED ALUMINUM ALLOY PRODUCTS HAVING IMPROVED APPEARANCE AND/OR ABRASION RESISTANCE, AND METHODS OF MAKING THE SAME

(71) Applicant: Alcoa Inc., Pittsburgh, PA (US)

(72) Inventors: Albert Askin, Lower Burrell, PA (US); Jennifer L. Giocondi, Monroeville, PA (US); Nicholas M. Denardo, McMurray, PA (US); Samantha M. Brandon, Mars, PA (US); Daniel L. Serafin, Wexford, PA (US)

(73) Assignee: ARCONIC INC., Pittsburgh, PA (US)

( * ) Notice: Subject to any disclaimer, the term of this patent is extended or adjusted under 35 U.S.C. 154(b) by 862 days.

(21) Appl. No.: 13/834,805

(22) Filed: Mar. 15, 2013

(65) Prior Publication Data

US 2014/0083861 A1 Mar. 27, 2014

Related U.S. Application Data

(60) Provisional application No. 61/704,958, filed on Sep. 24, 2012.

(51) Int. Cl.

| | |
|---|---|
| ***C25D 11/04*** | (2006.01) |
| ***C25D 11/18*** | (2006.01) |
| ***C25D 11/24*** | (2006.01) |

(52) U.S. Cl.
CPC ..... *C25D 11/246* (2013.01); *C25D 11/04* (2013.01); *C25D 11/24* (2013.01)

(58) Field of Classification Search
CPC ..... C25D 11/04; C25D 11/18; C25D 11/02
(Continued)

(56) References Cited

U.S. PATENT DOCUMENTS

| | | | | |
|---|---|---|---|---|
| 3,004,903 | A | 10/1961 | Mendizza | 204/38 |
| 3,107,159 | A | 10/1963 | Fetzer et al. | 29/195 |

(Continued)

FOREIGN PATENT DOCUMENTS

| | | |
|---|---|---|
| EP | 0143544 | 8/1988 |
| JP | 56-136997 | 10/1981 |

(Continued)

OTHER PUBLICATIONS

H. M. Ledbetter "Physical Properties Data Compilations Relevant to Energy Storage. Mechanical Properties on Alloys for Use in Flywheels" NSRDS-NBS 61, Part V, (Jan. 1982).*

(Continued)

*Primary Examiner* — Brian W Cohen
(74) *Attorney, Agent, or Firm* — Greenberg Traurig, LLP

(57) ABSTRACT

New methods of producing anodized aluminum alloy products having an improved surface appearance properties are disclosed. The methods may include preparing an aluminum alloy body for anodizing, thereby producing an anodized aluminum alloy body, contacting an intended viewing surface of the anodized aluminum alloy body with an acid, thereby producing a prepared intended viewing surface of the anodized aluminum alloy body, and sealing the prepared intended viewing surface of the anodized aluminum alloy body. The anodized aluminum alloy products may realize a preselected color tolerance, such as realizing a b* value that is within a specified tolerance of a preselected b* value.

37 Claims, 16 Drawing Sheets

(58) Field of Classification Search
USPC ..... 205/171, 174, 324, 202
See application file for complete search history.

(56) References Cited

U.S. PATENT DOCUMENTS

| | | | | |
|---|---|---|---|---|
| 3,709,742 | A | 1/1973 | Jacobs | 148/6.1 |
| 4,066,816 | A | 1/1978 | Sheasby et al. | 428/336 |
| 5,538,600 | A | 7/1996 | Schultz et al. | 428/31 |
| 5,728,503 | A * | 3/1998 | Dhillon et al. | 430/158 |
| 5,820,740 | A * | 10/1998 | Le et al. | 205/171 |
| 6,884,336 | B2 | 4/2005 | Kia et al. | 205/324 |
| 2002/0129484 | A1 | 9/2002 | Serafin et al. | 29/469.5 |
| 2003/0000409 | A1 | 1/2003 | Blake et al. | 101/454 |
| 2005/0056546 | A1 | 3/2005 | Kia et al. | 205/324 |
| 2006/0204780 | A1 | 9/2006 | Vega et al. | 428/687 |
| 2006/0219568 | A1* | 10/2006 | Hotta | C25D 11/045 205/173 |
| 2007/0092739 | A1* | 4/2007 | Steele | C25D 7/00 428/450 |
| 2009/0061216 | A1 | 3/2009 | Levendusky et al. | 428/336 |
| 2010/0183869 | A1 | 7/2010 | Lin et al. | 428/332 |
| 2010/0215926 | A1 | 8/2010 | Askin et al. | 428/209 |
| 2010/0218827 | A1* | 9/2010 | Aono | C25D 11/02 136/264 |
| 2011/0020665 | A1 | 1/2011 | Serafin et al. | 428/629 |
| 2013/0236712 | A1 | 9/2013 | Serafin et al. | 428/215 |
| 2013/0270120 | A1* | 10/2013 | Yao et al. | 205/50 |
| 2013/0292256 | A1* | 11/2013 | Hu | C25D 11/16 205/211 |

FOREIGN PATENT DOCUMENTS

| | | |
|---|---|---|
| JP | 06-240493 | 8/1994 |
| KR | 2009-0004254 | 1/2009 |
| WO | WO2010-083245 | 7/2010 |
| WO | WO2012-174733 | 12/2012 |

OTHER PUBLICATIONS

International Search Report and Written Opinion, dated Jan. 7, 2014, from co-owned, corresponding International Application No. PCT/US2013/061287.

Herwig, Robert S., et al., "Black Anodic Coatings on Aluminum Alloys", pp. 609-611, *The Monthly Review*, Jun. 1946.

Wernick S., "Colouring Anodic Coatings", pp. 361-364, The Surface Treatment and Finishing of Aluminium and its Alloys, 1959.

Material Safety Data Sheet—Anodal Deox LFN Liquid, Product Information, pp. 1-2, Clariant Corporation, Charlotte, NC, Revision date: Dec. 18, 2009, printing date: May 16, 2011.

Anodal Process Chemicals, pp. 1-2, Clariant Corporation, Coventry, Rhode Island, Feb. 2009.

Taber Abraser (Abstract), pp. 1-4, retrieved from the internet at http://www.taberindustries.com/taber-rotary-abraser, on Sep. 17, 2012.

Wikipedia, the free encyclopedia, "Color Difference", pp. 1-5, retrieved from the internet at http://en.wikipedia.org/wiki/Color_difference, on Sep. 21, 2012.

* cited by examiner

FIG. 9 - 7055 Δb*
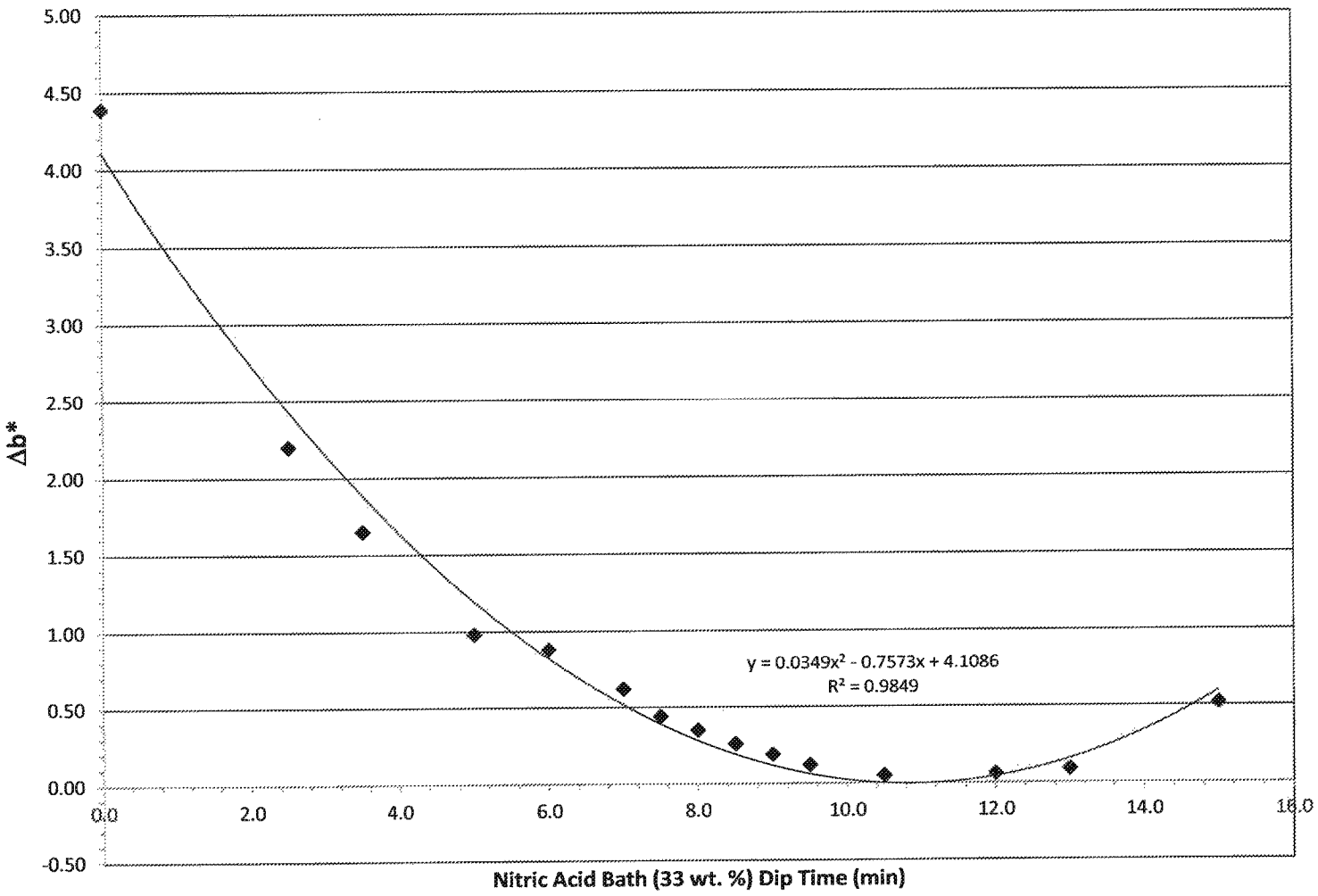

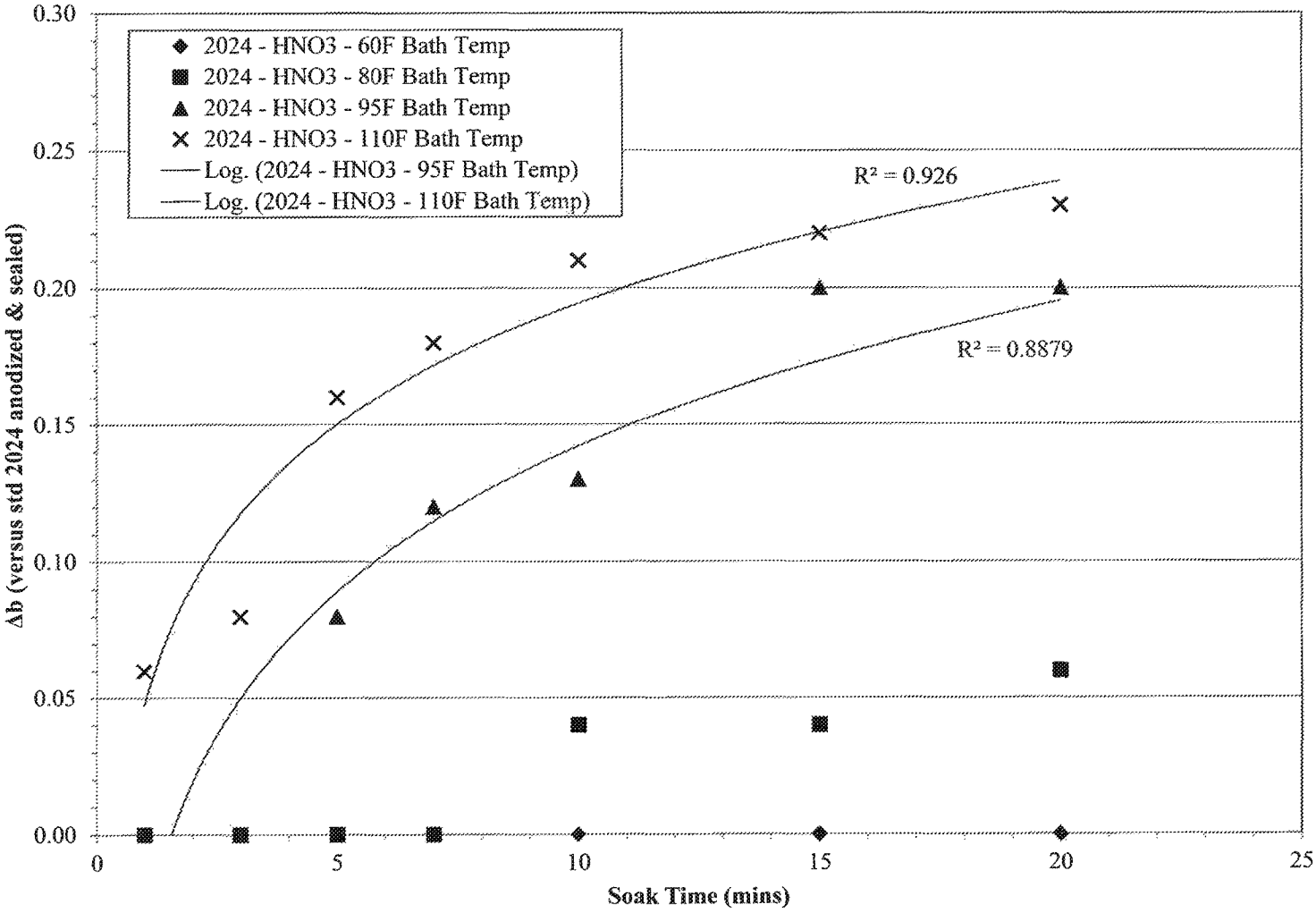
FIG. 10 - Alloy 2024 - Oxide Loss v. Nitric Acid Soak Time

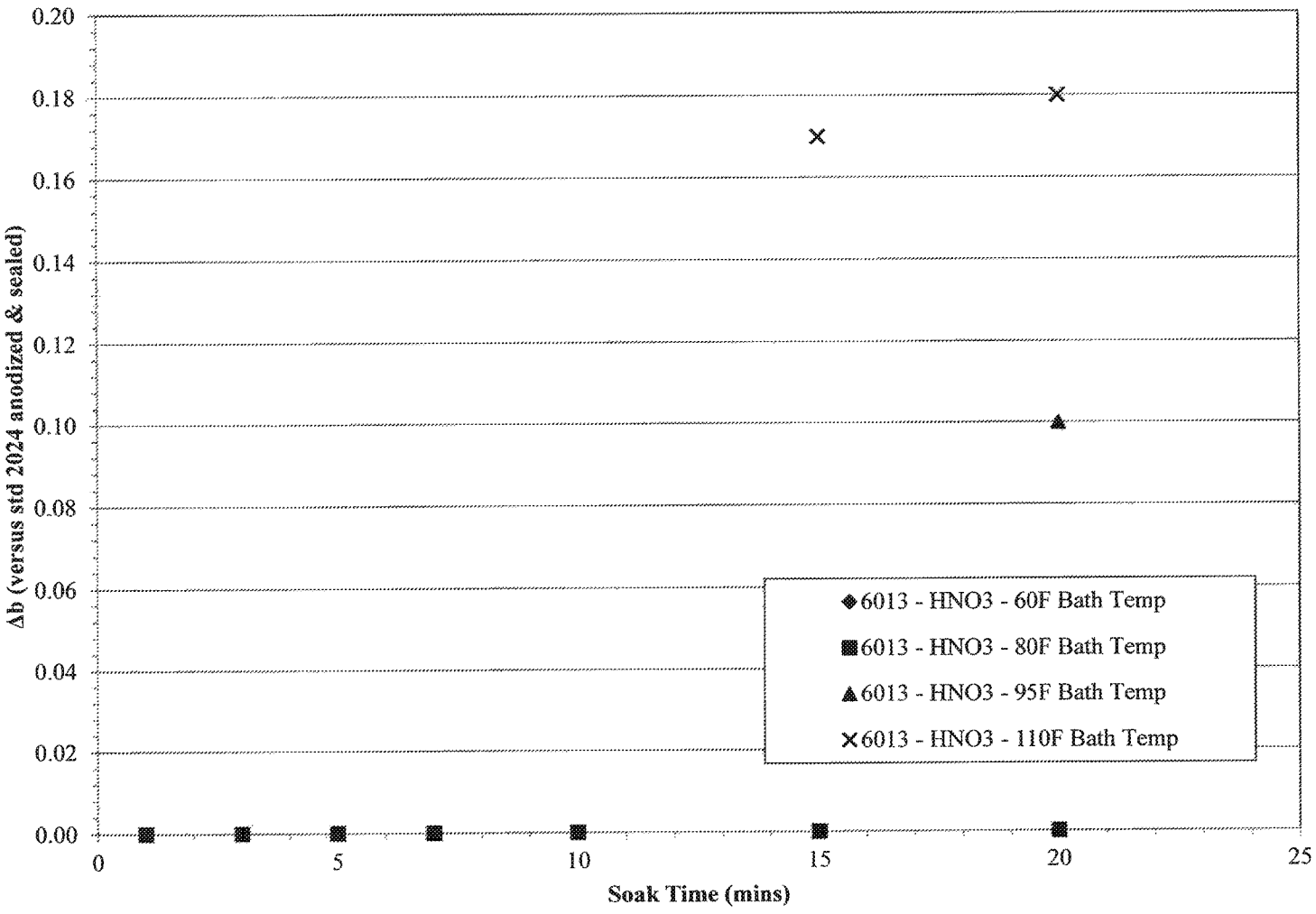
FIG. 11 - Alloy 6013 - Oxide Loss v. Nitric Acid Soak Time
Δb (versus std 2024 anodized & sealed)
0.20
0.18
0.16
0.14
0.12
0.10
0.08
0.06
0.04
0.02
0.00
0
5
10
15
20
25
Soak Time (mins)
6013 - HNO3 - 60F Bath Temp
6013 - HNO3 - 80F Bath Temp
6013 - HNO3 - 95F Bath Temp
6013 - HNO3 - 110F Bath Temp

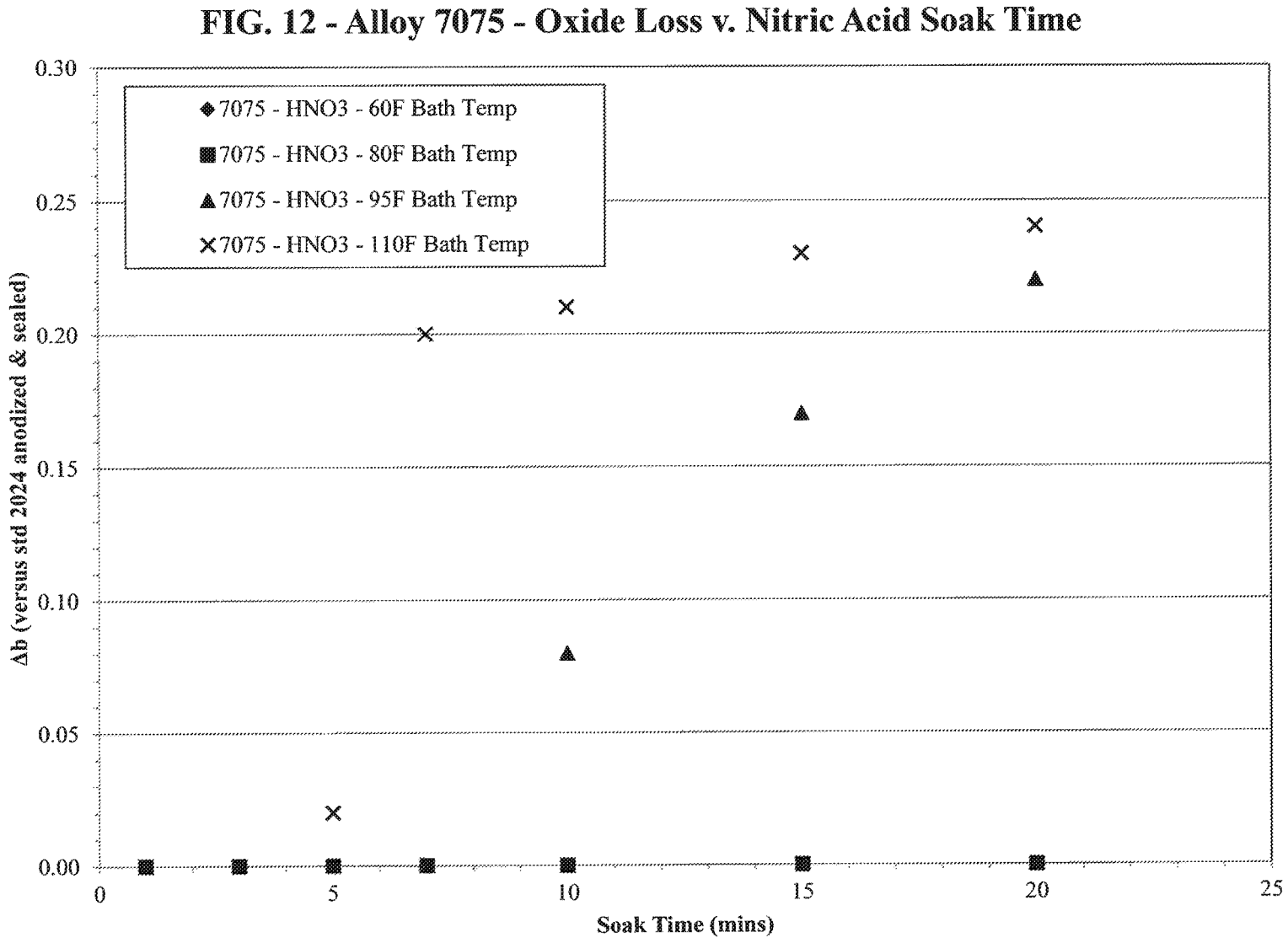
FIG. 12 - Alloy 7075 - Oxide Loss v. Nitric Acid Soak Time
7075 - HNO3 - 60F Bath Temp
7075 - HNO3 - 80F Bath Temp
7075 - HNO3 - 95F Bath Temp
7075 - HNO3 - 110F Bath Temp
Δb (versus std 2024 anodized & sealed)
0.30
0.25
0.20
0.15
0.10
0.05
0.00
0
5
10
15
20
25
Soak Time (mins)

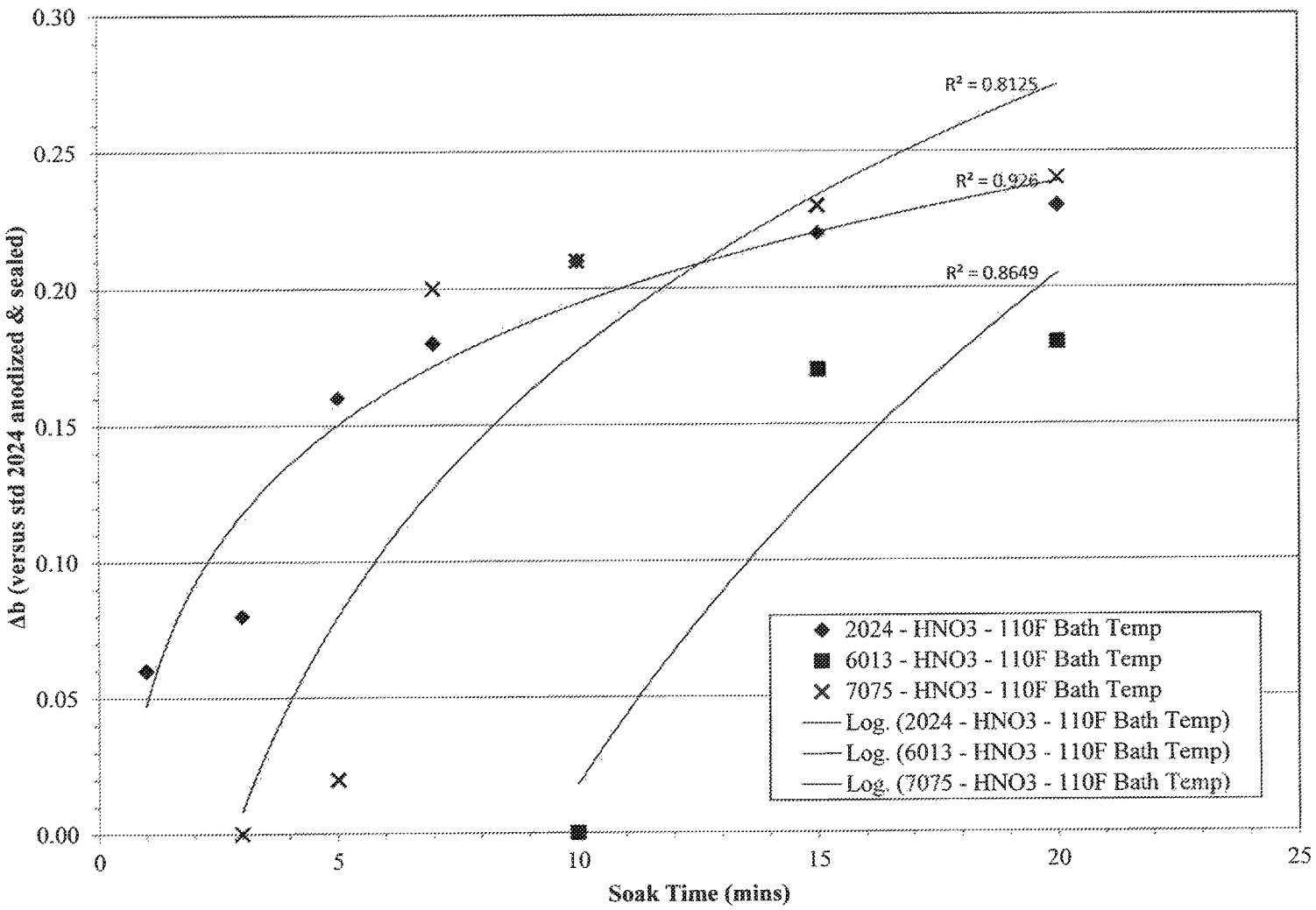
FIG. 13 - 110°F - Oxide Loss v. Nitric Acid Soak Time
Ab (versus std 2024 anodized & sealed)
0.30
0.25
0.20
0.15
0.10
0.05
0.00
0
5
10
15
20
25
Soak Time (mins)
R² = 0.8125
R² = 0.926
R² = 0.8649
2024 - HNO3 - 110F Bath Temp
6013 - HNO3 - 110F Bath Temp
7075 - HNO3 - 110F Bath Temp
Log. (2024 - HNO3 - 110F Bath Temp)
Log. (6013 - HNO3 - 110F Bath Temp)
Log. (7075 - HNO3 - 110F Bath Temp)

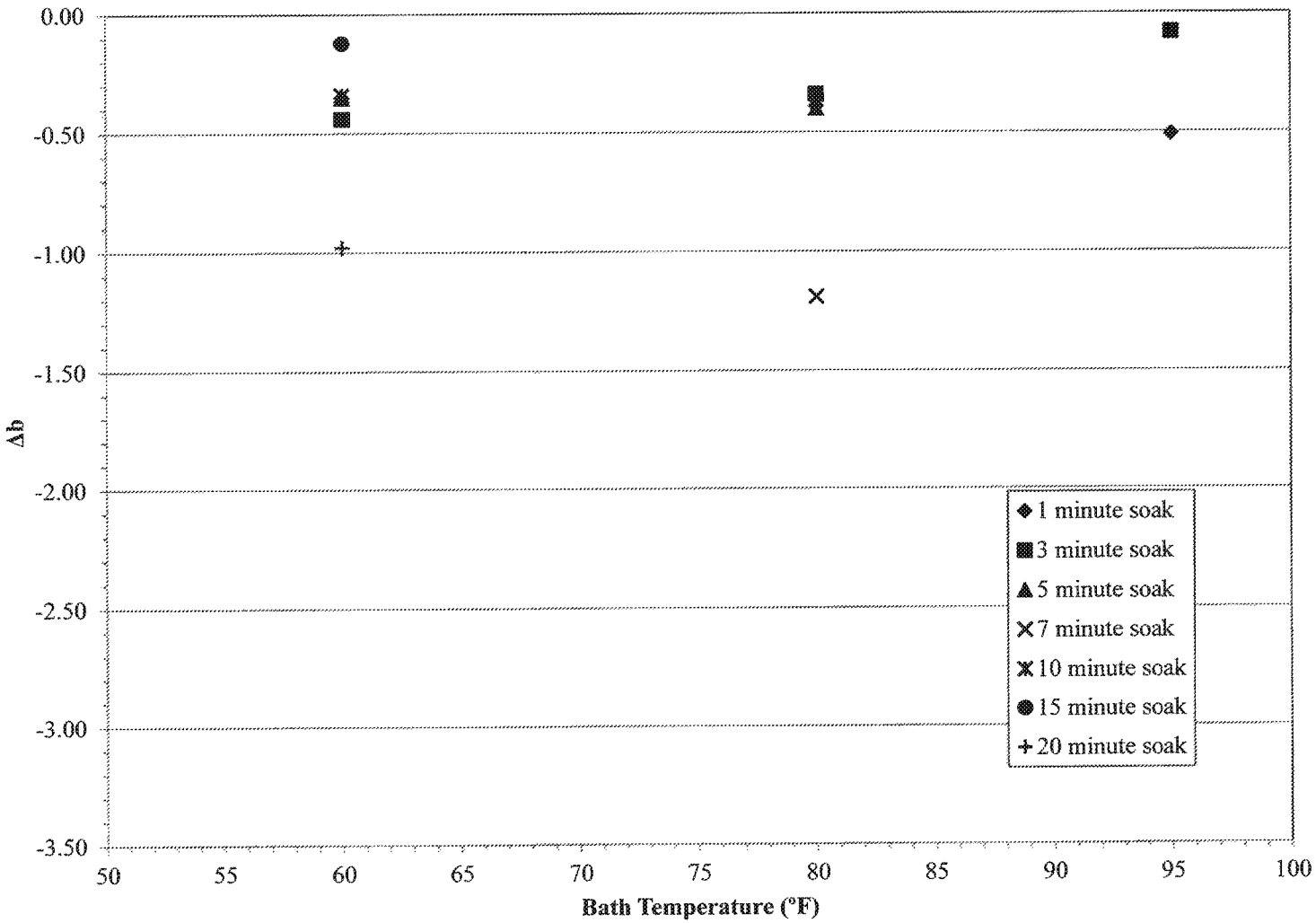
FIG. 14 - Alloy 2024 - Δb v. Bath Temperature
Δb
0.00
-0.50
-1.00
-1.50
-2.00
-2.50
-3.00
-3.50
50
55
60
65
70
75
80
85
90
95
100
Bath Temperature (°F)
1 minute soak
3 minute soak
5 minute soak
7 minute soak
10 minute soak
15 minute soak
20 minute soak

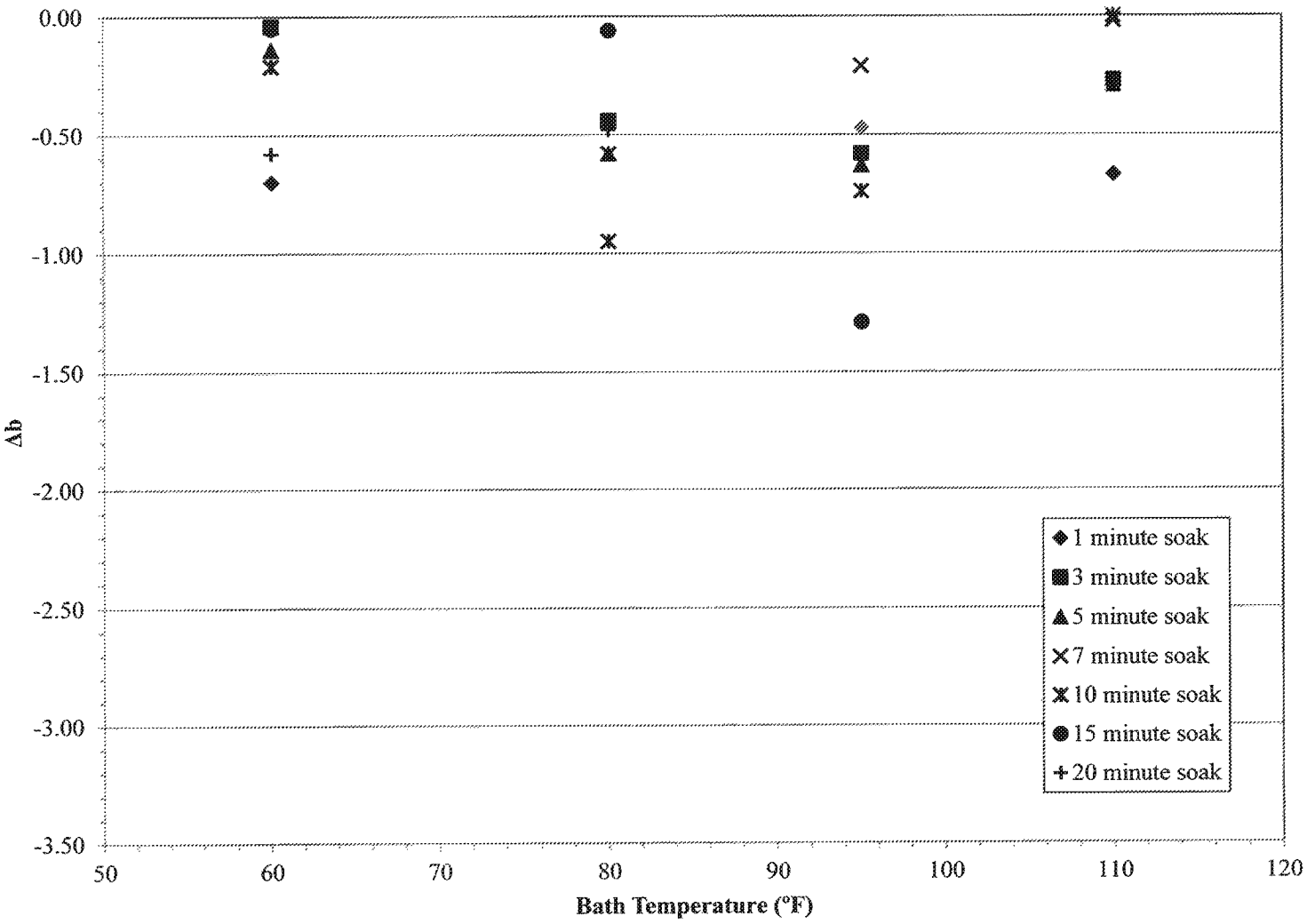
FIG. 15 - Alloy 6013 - Δb v. Bath Temperature

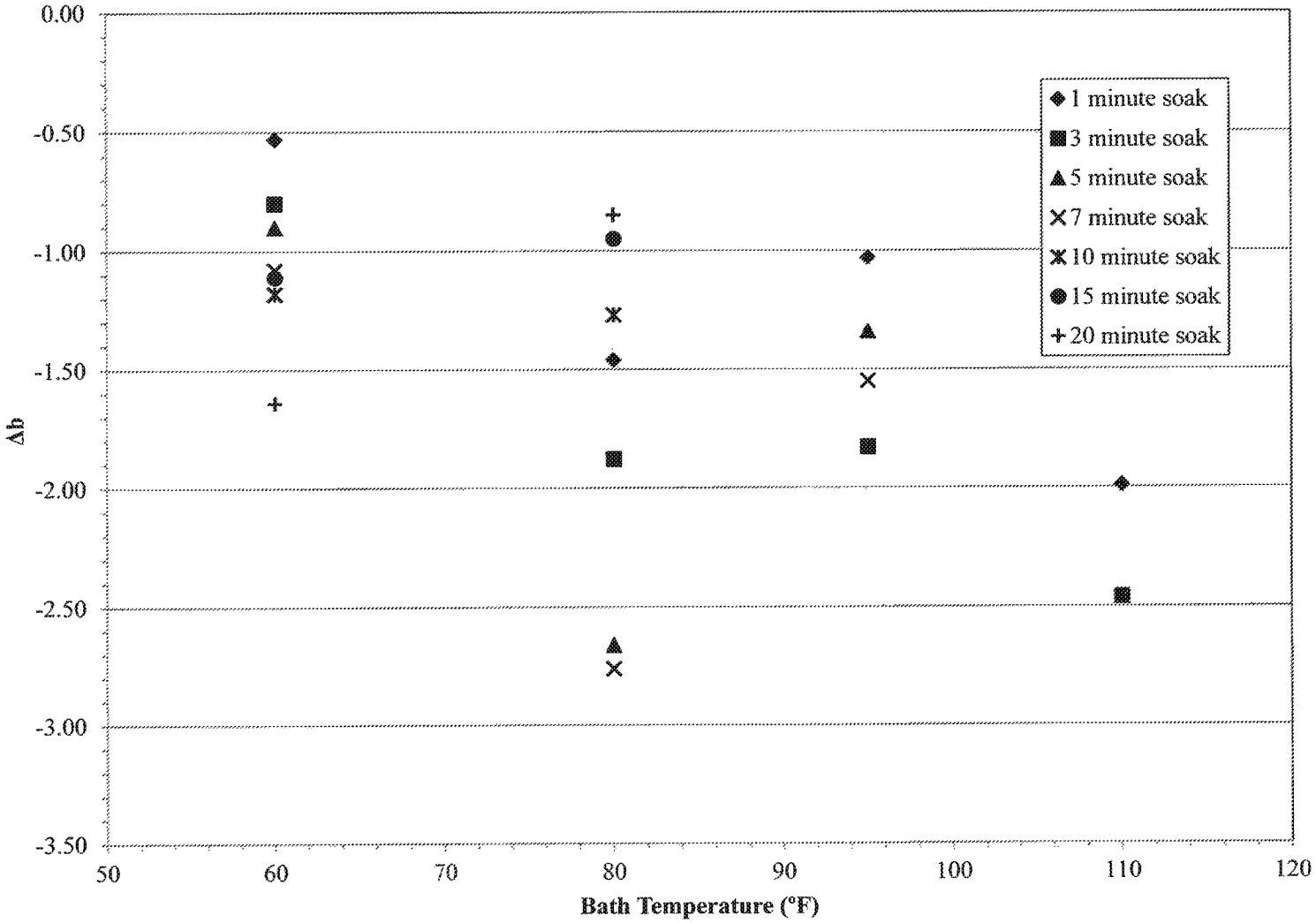
FIG. 16 - Alloy 7075 - Δb v. Bath Temperature

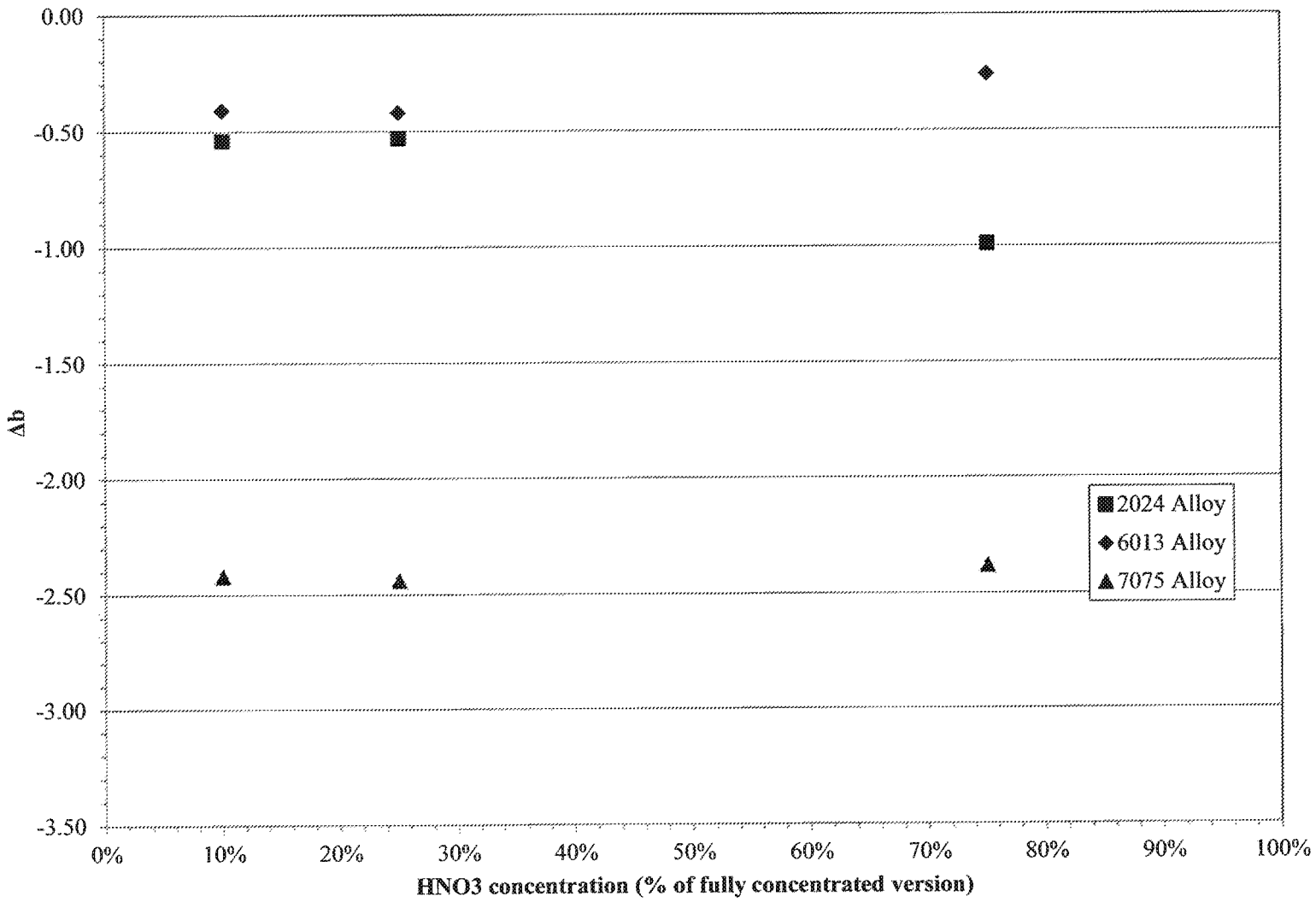
FIG. 17 - Alloys - Δb v. Nitric Acid Concentration

ANODIZED ALUMINUM ALLOY PRODUCTS HAVING IMPROVED APPEARANCE AND/OR ABRASION RESISTANCE, AND METHODS OF MAKING THE SAME

CROSS-REFERENCE TO RELATED APPLICATION

This patent application claims priority to U.S. Provisional Patent Application No. 61/704,958, entitled "ANODIZED HIGH STRENGTH ALUMINUM ALLOY PRODUCTS HAVING PRESELECTED SURFACE APPEARANCE AND ABRASION RESISTANCE, AND METHODS OF MAKING THE SAME", filed Sep. 24, 2012, and which is incorporated herein by reference in its entirety.

BACKGROUND

Façades for consumer products, such as consumer electronic products, must meet a variety of criteria in order to be commercially viable. Among those criteria are durability and visual appearance. Lightweight, strong, durable and visually appealing façades would be useful in consumer product applications, among others.

SUMMARY OF THE DISCLOSURE

Broadly, the present disclosure relates to aluminum alloy bodies or products having improved surface appearance and/or abrasion resistance. One embodiment of producing such aluminum alloy bodies or products is illustrated in FIG. 1, where a preselected surface appearance and/or a preselected abrasion resistance (durability) of an intended viewing surface of an aluminum alloy product is determined (10) and the aluminum alloy product is prepared (100) for anodizing. The determining step (10) may occur before, during or after the preparing step (100).

After the preparing step (100), the aluminum alloy product is anodized (200) thereby producing an anodic oxide zone in the aluminum alloy product, wherein the anodic oxide zone is associated with the intended viewing surface of the aluminum alloy product. The anodic oxide zone generally has a thickness of from 0.07 mil to 4.5 mil (about 1.8 microns to about 114.3 microns).

After the anodizing step (200), the anodic oxide zone of the aluminum alloy product is treated (300) with an acid for a time sufficient such that the intended viewing surface of the anodized aluminum alloy product achieves one or both of the preselected surface appearance and the preselected abrasion resistance. After the treating step (300), the anodic oxide zone of the aluminum alloy product may be optionally colored (500). After the treating step (300) and any optional coloring step (500), the anodic oxide zone of the aluminum alloy product may be sealed (400).

The aluminum alloy may be any wrought aluminum alloy, or any casting aluminum alloy. Wrought aluminum alloys include the 1xxx, 2xxx, 3xxx, 4xxx, 5xxx, 6xxx, 7xxx, and 8xxx aluminum alloys, as defined by the Aluminum Association. Casting aluminum alloys include the 1xx.x, 2xx.x, 3xx.x, 4xx.x, 5xx.x, 7xx.x, and 8xx.x aluminum alloys.

The aluminum alloy may be a high strength aluminum alloy. As used herein, a "high strength aluminum alloy" is an aluminum alloy product having a longitudinal (L) tensile yield strength of at least 275 MPa. Examples of aluminum alloys suited to achieve such high strengths include the wrought 2xxx, 5xxx, 6xxx, and 7xxx aluminum alloys, as well as shape cast 3xx.x aluminum alloys. In one embodiment, a high strength aluminum alloy product has a longitudinal (L) tensile yield strength of at least 300 MPa. In another embodiment, a high strength aluminum alloy product has a longitudinal (L) tensile yield strength of at least 350 MPa. In yet another embodiment, a high strength aluminum alloy product has a longitudinal (L) tensile yield strength of at least 400 MPa. In another embodiment, a high strength aluminum alloy product has a longitudinal (L) tensile yield strength of at least 450 MPa. In yet another embodiment, a high strength aluminum alloy product has a longitudinal (L) tensile yield strength of at least 500 MPa. In another embodiment, a high strength aluminum alloy product has a longitudinal (L) tensile yield strength of at least 550 MPa. In yet another embodiment, a high strength aluminum alloy product has a longitudinal (L) tensile yield strength of at least 600 MPa. In another embodiment, a high strength aluminum alloy product has a longitudinal (L) tensile yield strength of at least 625 MPa.

In one approach, a high strength aluminum alloy is a 2xxx aluminum alloy. In one embodiment, a 2xxx aluminum alloy comprises 0.5-6.0 wt. % Cu, and optionally up to 1.9 wt. % Mg, usually at least 0.2 wt. % Mg. In one embodiment, a 2xxx alloy is one of a 2x24, 2026, 2014, or 2x19 aluminum alloy.

In one approach, a high strength aluminum alloy is a 6xxx aluminum alloy. In one embodiment, the 6xxx aluminum alloy includes 0.1-2.0 wt. % Si and 0.1-3.0 wt. % Mg, optionally with up to 1.5 wt. % Cu. In one embodiment, a 6xxx aluminum alloy comprises 0.25 wt. %-1.30 wt. % Cu. In one embodiment, a 6xxx aluminum alloy comprises 0.25 wt. %-1.0 wt. % Zn. In one embodiment, a 6xxx alloy is one of a 6013, 6111 or 6061 aluminum alloy.

In one approach, a high strength aluminum alloy is a 7xxx aluminum alloy. In one embodiment, a 7xxx alloy comprises 4-12 wt. % Zn, 1-3 wt. % Mg, and 0-3 wt. % Cu. In one embodiment, a 7xxx alloy is one of a 7x75, 7x50, 7x55, or 7x85 aluminum alloy.

In one approach, the aluminum alloy is a wrought rolled product having a thickness of from 0.006 inch to 0.500 inch. In another approach, the aluminum alloy is a wrought extruded product. In another approach, the aluminum alloy is a cast plate product. In other embodiments, the aluminum alloy is a shape cast product, wherein the product achieves its final or near final product form after the aluminum alloy casting process. A shape cast product is in final form if it requires no machining after casting. A shape cast product is in near final form if it requires some machining after casting. By definition, shape cast products excludes wrought products, which generally require hot and/or cold work after casting to achieve their final product form. Shape cast products may be produced via any suitable casting process, such as die casting and permanent mold casting processes, among others.

In one embodiment, the shape cast products are "thin walled" shape cast products. In these embodiments, the shape cast products have a nominal wall thickness of not greater than about 1.0 millimeter. In one embodiment, a shape cast product has a nominal wall thickness of not greater than about 0.99 mm. In another embodiment, a shape cast product has a nominal wall thickness of not greater than about 0.95 mm. In other embodiments, the shape cast product has a nominal wall thickness of not greater than about 0.9 mm, or not greater than about 0.85 mm, or not greater than about 0.8 mm, or not greater than about 0.75 mm, or not greater than about 0.7 mm, or not greater than about 0.65 mm, or not greater than about 0.6 mm, or not greater than about 0.55 mm, or not greater than about 0.5 mm, or even less.

Referring now to FIG. 2, the determining step 10 is optional and includes determining a preselected surface appearance and/or a preselected abrasion resistance (durability) of an intended viewing surface of an aluminum alloy product. As used herein, "an intended viewing surface" is a surface that is intended to be viewed by a consumer during normal use of the product. Internal surfaces are generally not intended to be viewed during normal use of the product.

As used herein, "a preselected surface appearance of an intending viewing surface" means an appearance of an intended viewing surface that is preselected in advance of at least one of the anodizing step (200) and the treating step (300). The preselected surface appearance may be one or more of a preselected color tolerance (20) and a gloss tolerance (30), among others. Color tolerance (20) does not require application of a color to the aluminum alloy product. Color tolerance (20) may be of an uncolored anodized (200), treated (300) and sealed (400) aluminum alloy product.

As used herein, a "preselected color tolerance" means a tolerance relative to one or more of an "L* value", an "a* value" and a "b* value" as per CIElab 1976, i.e., a preselected color tolerance is one or more of a preselected b*, a*, or L* tolerance as per CIElab 1976. A preselected b*, a*, or L* tolerance means the tolerance relative to a specified b*, a*, or L* value. For example, if a specified b* value is −0.5 and a tolerance of +/−0.1 is required, then the preselected b* tolerance is −0.4 to −0.6. Color tolerance may be measured using a Technidyne Corp. ColorTouch PC, or similar instrumentation.

In one embodiment, the preselected surface appearance comprises a preselected b* tolerance, where a preselected (target) b* value is selected, and the intended viewing surface of the final aluminum alloy product is within a specified tolerance of the preselected b* value. In one embodiment, the intended viewing surface of the final aluminum alloy product realizes an actual b* value that is within the 1.0 unit of the target b* value. For example, if the preselected b* value is 5.3, and the b* tolerance is 1.0 unit, the anodized intended viewing surface of the final aluminum alloy product would achieve an actual b* value of from 4.3 to 6.3 (i.e., 5.3+/−1.0). In another embodiment, the intended viewing surface of the final aluminum alloy product realizes an actual b* value that is within the 0.5 unit of the target b* value. In yet another embodiment, the intended viewing surface of the final aluminum alloy product realizes an actual b* value that is within the 0.4 unit of the target b* value. In another embodiment, the intended viewing surface of the final aluminum alloy product realizes an actual b* value that is within the 0.3 unit of the target b* value. In yet another embodiment, the intended viewing surface of the final aluminum alloy product realizes an actual b* value that is within the 0.2 unit of the target b* value. In yet another embodiment, the intended viewing surface of the final aluminum alloy product realizes an actual b* value that is within the 0.1 unit of the target b* value.

In one embodiment, the preselected surface appearance comprises a preselected a* tolerance. In one embodiment, the intended viewing surface of the final aluminum alloy product realizes an actual a* value that is within the 1.0 unit of the target a* value. For example, if the preselected a* value is −1.8, and the a* tolerance is 1.0 unit, the anodized intended viewing surface of the final aluminum alloy product would achieve an actual a* value of from −2.8 to −1.8 (i.e., −1.8+/−1.0). In another embodiment, the intended viewing surface of the final aluminum alloy product realizes an actual a* value that is within the 0.75 unit of the target a* value. In yet another embodiment, the intended viewing surface of the final aluminum alloy product realizes an actual a* value that is within the 0.5 unit of the target a* value. In another embodiment, the intended viewing surface of the final aluminum alloy product realizes an actual a* value that is within the 0.4 unit of the target a* value. In yet another embodiment, the intended viewing surface of the final aluminum alloy product realizes an actual a* value that is within the 0.3 unit of the target a* value. In another embodiment, the intended viewing surface of the final aluminum alloy product realizes an actual a* value that is within the 0.2 unit of the target a* value. In yet another embodiment, the intended viewing surface of the final aluminum alloy product realizes an actual a* value that is within the 0.1 unit of the target a* value. In yet another embodiment, the intended viewing surface of the final aluminum alloy product realizes an actual a* value that is within the 0.05 unit of the target a* value.

In one embodiment, the preselected surface appearance comprises a preselected L* tolerance. In one embodiment, the intended viewing surface of the final aluminum alloy product realizes an actual L* value that is within the 2.0 units of the target L* value. For example, if the preselected L* value is 70, and the L* tolerance is 2.0 unit, the anodized intended viewing surface of the final aluminum alloy product would achieve an actual L* value of from 68 to 72 (i.e., 70+/−2.0). In another embodiment, the intended viewing surface of the final aluminum alloy product realizes an actual L* value that is within the 1.5 unit of the target L* value. In yet another embodiment, the intended viewing surface of the final aluminum alloy product realizes an actual L* value that is within the 1.0 unit of the target L* value. In another embodiment, the intended viewing surface of the final aluminum alloy product realizes an actual L* value that is within the 0.75 unit of the target L* value. In yet another embodiment, the intended viewing surface of the final aluminum alloy product realizes an actual L* value that is within the 0.5 unit of the target L* value. In yet another embodiment, the intended viewing surface of the final aluminum alloy product realizes an actual L* value that is within the 0.25 unit of the target L* value.

In one approach, both b* and a* target values are preselected, and the intended viewing surface of the final aluminum alloy product realizes actual b* and a* values that are within specified tolerances, such as any of the tolerances provided above. In another approach, both L* and a* target values are preselected, and the intended viewing surface of the final aluminum alloy product realizes actual L* and a* values that are within specified tolerances, such as any of the tolerances provided above. In yet another approach, both L* and b* target values are preselected, and the intended viewing surface of the final aluminum alloy product realizes actual L* and b* values that are within specified tolerances, such as any of the tolerances provided above.

In another approach, all of b*, a* and L* are preselected, and the intended viewing surface of the final aluminum alloy product realizes actual b*, a* and L* values that are within specified tolerances, such as any of the tolerances provided above, and the tolerance is determined using Delta-E (1976), wherein:

$$\text{Delta-}E=((L^*psv-L^*mv)^2+(a^*psv-a^*mv)^2+(b^*psv-b^*mv)^2)^{1/2}$$

where:

(1) L*psv is a preselected L* value;

(2) a*psv is a preselected a* value;
(3) b*psv is a preselected b* value;
(4) L*mv is the measured L* value relative to the aluminum alloy product;
(5) a*mv is the measured a* value relative to the aluminum alloy product; and
(6) b*mv is the measured b* value relative to the aluminum alloy product.

In one embodiment, the intended viewing surface of the aluminum alloy achieves not greater than 5.0 Delta E relative to a preselected Delta E. In other embodiments, the intended viewing surface of the aluminum alloy achieves not greater than 2.5 Delta E, or not greater than 1.0 Delta E, or not greater than 0.75 Delta E, or not greater than 0.5 Delta E, or not greater than 0.1 Delta E, or not greater than 0.05 Delta E, or less, relative to a preselected Delta E.

The treating step (300) may result in decreasing the "yellowness" of an anodized aluminum alloy product. In this regard, the treating step (300) may result in the intended viewing surface of the final aluminum alloy product realizing a decrease in b* relative to a reference-version of the intended viewing surface of the aluminum alloy product in the anodized and sealed condition. The reference-version of the aluminum alloy product is made by excluding the treatment step (300) when processing the aluminum alloy product, i.e., the reference-version is anodized (200) and then sealed (400). Since the reference-version of the aluminum alloy product is made from the same aluminum alloy as the new (treated (300)) aluminum alloy product, both the new (treated (300)) product and the reference-version of the product will have the same product form and composition. The b* values of the reference-version and the new aluminum alloy products are measured after the sealing step (400), i.e., both are sealed under the same sealing conditions, after which their b* values are measured. In one embodiment, the intended viewing surface of the final aluminum alloy product realizes a decrease in b* of at least 0.10 unit relative to a reference-version of the intended viewing surface of the aluminum alloy product in the anodized and sealed condition. In another embodiment, the intended viewing surface of the final aluminum alloy product realizes a decrease in b* of at least 0.20 unit relative to a reference-version of the intended viewing surface of the aluminum alloy product in the anodized and sealed condition. In yet another embodiment, the intended viewing surface of the final aluminum alloy product realizes a decrease in b* of at least 0.40 unit relative to a reference-version of the intended viewing surface of the aluminum alloy product in the anodized and sealed condition. In another embodiment, the intended viewing surface of the final aluminum alloy product realizes a decrease in b* of at least 0.60 unit relative to a reference-version of the intended viewing surface of the aluminum alloy product in the anodized and sealed condition. In yet another embodiment, the intended viewing surface of the final aluminum alloy product realizes a decrease in b* of at least 0.80 unit relative to a reference-version of the intended viewing surface of the aluminum alloy product in the anodized and sealed condition. In another embodiment, the intended viewing surface of the final aluminum alloy product realizes a decrease in b* of at least 1.00 unit relative to a reference-version of the intended viewing surface of the aluminum alloy product in the anodized and sealed condition.

The gloss tolerance (30) is measured on the intended viewing surface of the final aluminum alloy product and using 60° Specular Gloss using BYK-Gardner Haze-Gloss Meter and ASTM D523-08 Standard Test Method for Specular Gloss.

The intending viewing surface of the aluminum alloy product may be substantially free of visually apparent surface defects. "Substantially free of visually apparent surface defects" means that the intended viewing surfaces of the product are substantially free of surface defects as viewed by human eyesight, with 20/20 vision, when the aluminum alloy product is located at least 18 inches away from the eyes of the human viewing the aluminum alloy product. Visually apparent surface defects include, for instance, those cosmetic defects that can be viewed due to the alloy microstructure (e.g., the presence of randomly located particles at or near the intended viewing surface of the product), among others.

The preselected abrasion resistance (50) is the abrasion resistance of the intending viewing surface of the aluminum alloy product as determined via ASTM D4060-10 Standard Test Method for Abrasion Resistance of Organic Coatings by the Taber Abraser and using the test conditions (CS-17 wheel, 1000 g load, 70 RPM) as specified by MIL-A-8625F—Military Specification: Anodic Coatings for Aluminum and Aluminum Alloys (measure sample weight and reface wheel after 1000 cycles). In one embodiment, the preselected abrasion resistance is not greater than 100 mg weight loss per 1000 cycles. In another embodiment, the preselected abrasion resistance is not greater than 75 mg weight loss per 1000 cycles. In yet another embodiment, the preselected abrasion resistance is not greater than 50 mg weight loss per 1000 cycles. In another embodiment, the preselected abrasion resistance is not greater than 40 mg weight loss per 1000 cycles. In yet another embodiment, the preselected abrasion resistance is not greater than 35 mg weight loss per 1000 cycles. In another embodiment, the preselected abrasion resistance is not greater than 30 mg weight loss per 1000 cycles. In yet another embodiment, the preselected abrasion resistance is not greater than 25 mg weight loss per 1000 cycles. In another embodiment, the preselected abrasion resistance is not greater than 20 mg weight loss per 1000 cycles. In yet another embodiment, the preselected abrasion resistance is not greater than 16 mg weight loss per 1000 cycles.

Referring now to FIGS. 1 and 3, before or after the optional determining step (10), the aluminum alloy product may be prepared (100) for anodizing. The preparing step may include one or more of cleaning (110) and/or brightening (120) of an aluminum alloy product such that the intended viewing surface of the aluminum alloy product is suitable for anodizing. The cleaning step (110), may include, for example, one or more of mechanical blasting, chemical cleaning (e.g., in a non-etching aqueous alkaline cleaning solution to remove organic surface contaminants), and chemical etching (e.g., a caustic, such as sodium hydroxide), among others. The brightening step (120) may include contacting the aluminum alloy with a chemical brightening composition and/or electropolishing. As used herein, "chemical brightening composition" means a solution that includes at least one of nitric acid, phosphoric acid, sulfuric acid, and combinations thereof. For example, the methodologies and compositions disclosed in U.S. Pat. No. 6,440,290 to Vega et al. may be employed to chemically brighten an aluminum alloy product.

Referring now to FIGS. 1 and 4, after the preparing step (100), the aluminum alloy product is anodized (200). The anodizing (200) step produces an anodic oxide zone in the aluminum alloy product, where the anodic oxide zone includes a plurality of pores. This anodic oxide zone facilitates abrasion resistance of the aluminum alloy product. The anodizing (200) may employ any suitable electrochemical bath, such as any of sulfuric acid (210), phosphoric acid (220), chromic acid (230), oxalic acid (240), and combinations thereof (250). In one embodiment, the anodizing is Type II or Type III anodizing (212) employing a sulfuric acid bath to produce the anodic oxide zone. The anodic oxide zone generally has a thickness of from 0.07 mil to 4.5 mil. Anodic oxide zone thickness is measured in accordance with ASTM B244-09 Standard Test Method for Measurement of Thickness of Anodic Coatings on Aluminum and of Other Nonconductive Coatings on Nonmagnetic Basis Metals with Eddy-Current Instruments. As used herein, Type-II anodizing means anodizing with a sulfuric acid electrolyte to an oxide thickness of from 0.07 to 1.00 mil. As used herein, Type-III anodizing means anodizing with a sulfuric acid electrolyte to an oxide thickness of 0.5 to 4.5 mil, and with an abrasion resistance of at least 3.5 mg/1000 cycles.

Referring now to FIGS. 1 and 5, after the anodizing step (200), the anodic oxide zone may be treated (300) for a time and at a temperature sufficient such that the intended viewing surface of the anodized aluminum alloy product achieves the preselected surface appearance and/or the preselected abrasion resistance (314). The treating step (300) may comprise contacting the intended viewing surface of the anodized aluminum alloy product with the acid. By properly treating the anodized intending view surface of the anodized aluminum alloy product with an acid, the preselected surface appearance and/or the preselected abrasion resistance may be realized. For example, if the treatment step (300) is too long, the abrasion resistance may be too low. If the treatment step (300) is too short, surface appearance properties may not be achieved. In one embodiment, the acid is selected from the group consisting of nitric acid, phosphoric acid, sulfuric acid, acetic acid, and combinations thereof (312). The acid may be used in concentrated form or a diluted form, as shown by the below examples.

In one embodiment, the treating step (300) comprises contacting the intended viewing surface of the anodized aluminum alloy product with nitric acid, such as via immersion in a nitric acid bath. The nitric acid may be a concentrated nitric acid (67% nitric acid by weight) or a diluted version thereof. For example, this concentrated nitric acid may be diluted 1:1 to achieve about a 33 wt. % nitric acid bath. In another example, this concentrated nitric acid may be diluted 5:1 to achieve about a 13.4 wt. % nitric acid bath. In yet another example, this concentrated nitric acid may be diluted 10:1 to achieve about a 6.7 wt. % nitric acid bath. In another example, this concentrated nitric acid may be diluted 100:1 to achieve about a 0.67 wt. % nitric acid bath. Thus, the nitric acid may be from 0.67% to 67% (wt.) of a liquid bath. Other concentrations may be employed.

The temperature of the acid solution (e.g., an acid spray or bath) should generally be from 40° to 110° F., and may depend on the type of alloy being treated. As shown by the below examples, if the acid solution temperature is too cold, preselected surface appearance properties may not be achieved and/or low throughput may be realized. If the temperature is too hot, the anodic oxide zone may be degraded (i.e., the preselected abrasive resistance may not be achieved) and/or the preselected surface appearance properties may not be achieved. In one embodiment, the acid solution has a temperature of from 60° F. to 100° F. In another embodiment, the acid solution has a temperature of from 60° to 95° F. In one embodiment, the acid solution has a temperature of from 70° to 90° F.

As noted above, and as shown by the below examples, when the determining step (10) is employed, the treatment step (300) should be sufficiently long to achieve the preselected surface appearance properties. However, the treatment step (300) should not be so long so as to degrade abrasion resistance (e.g., by unacceptably decreasing the anodic oxide zone thickness) and/or unnecessarily limit throughput. In this regard, the duration of the treating step (300) is generally from 1 minute to not greater than 60 minutes, and generally depends on the acid concentration and/or the treatment temperature and/or the alloy being treated. In one embodiment, the duration of the treating step (300) is at least 2 minutes. In another embodiment, the duration of the treating step (300) is at least 3 minutes. In one embodiment, the duration of the treating step (300) is not greater than 30 minutes. In another embodiment, the duration of the treating step (300) is not greater than 20 minutes.

As mentioned above, the treating step (300) may be accomplished to at least partially maintain the thickness of the anodic oxide zone. At least partially maintaining the thickness of the anodic oxide zone may facilitate achievement of any preselected abrasion resistance. More particularly, the anodizing step (200) will produce an anodic oxide zone having an average thickness, such as in the range of from about 0.07 mil to about 4.5 mil. This average anodic oxide zone thickness is sometimes referred to herein as the pre-treating (or pre-contacting) anodic oxide zone thickness. The treating step (300) may be accomplished so as to at least partially maintain this anodic oxide zone thickness. The thickness of the anodic oxide zone after the treating step (300) is sometimes referred to herein as the final anodic oxide zone thickness. In one embodiment, the final anodic oxide zone thickness is within 10% of the pre-treating anodic oxide zone thickness. For example, if the pre-treating anodic oxide zone thickness was 0.263 mil (about 6.68 microns), the final anodic oxide zone thickness would be no more than 10% less than 0.263 mil, i.e., the final anodic oxide zone thickness would be at least 0.2637 mil (at least about 6.01 microns). In another embodiment, the final anodic oxide zone thickness is within 7% of the pre-treating anodic oxide zone thickness. In yet another embodiment, the final anodic oxide zone thickness is within 5% of the pre-treating anodic oxide zone thickness. In another embodiment, the final anodic oxide zone thickness is within 3% of the pre-treating anodic oxide zone thickness. In yet another embodiment, the final anodic oxide zone thickness is within 1% of the pre-treating anodic oxide zone thickness.

In some embodiments, after the preparing step (100), the aluminum alloy product may comprise a plurality of particles, such as particles having an average size (D0.5) of from 0.100 micron to 30 micron, such as when the aluminum alloy is a high strength aluminum alloy. After the anodizing (200), at least some of the above-mentioned particles may be contained within the anodic oxide zone, i.e., some of the particles of the aluminum alloy product may be contained in the anodic oxide zone. Such particles may be detrimental, for example, to achievement of a predetermined surface appearance. Thus, the treating step (300) may include removing at least some of the particles contained within the anodic oxide zone via the acid (e.g., nitric acid). In one embodiment, the treating step (300) includes removing at least some of the particles contained within the anodic oxide zone via the acid. The treating step (300) may also include enlarging of the pores of the anodic oxide zone, which may also/alternatively facilitate achievement of a preselected surface appearance.

Referring now to FIGS. 1, 2 and 6, after the treating step (300), the anodic oxide zone may be sealed (400), such as by contacting with boiling water (410) or nickel acetate (420), among other suitable sealing solutions. After the sealing step (400), the intended viewing surface of the aluminum alloy product may realize the preselected surface appearance and/or the preselected abrasion resistance.

Referring now to FIGS. 1 and 7, between the treating step (300) and the sealing step (400), the anodic oxide zone may optionally be colored (500), such as by immersing the anodic oxide zone in a dye, or using any other known suitable coloring process. In other embodiments, the coloring step (500) is absent and the intended viewing surface of the final aluminum alloy product realizes the preselected surface appearance and/or the preselected abrasion resistance without coloring the anodic oxide zone of the final aluminum alloy product. In embodiments where the coloring step is absent, the method may consist of the optional determining step (10), and the non-optional preparing (100), anodizing (200), treating (300), and sealing (400) steps.

As noted above, the determining step (10) is optional. For example, the presently disclosed method may be useful in producing anodized aluminum alloy products simply by employing the preparing (100), anodizing (200), treating (300), and sealing (400) steps, optionally with the coloring (500) step. In this regard, the treating step (300) may be used to facilitate production of anodized aluminum alloy products having good surface appearance properties and abrasion resistance, and without the need to preselect any appearance and/or properties.

These and other aspects and advantages, and novel features of this new technology are set forth in part in the description that follows and will become apparent to those skilled in the art upon examination of the following description and figures, or may be learned by practicing one or more embodiments of the technology provided for by the present disclosure.

BRIEF DESCRIPTION OF THE DRAWINGS

FIG. 9 is a graph illustrating Δb* results of Example 2.

FIGS. 10-17 are graphs illustrating various oxide thickness and Δb* results of Example 4.

DETAILED DESCRIPTION

Example 1

Figure 1:
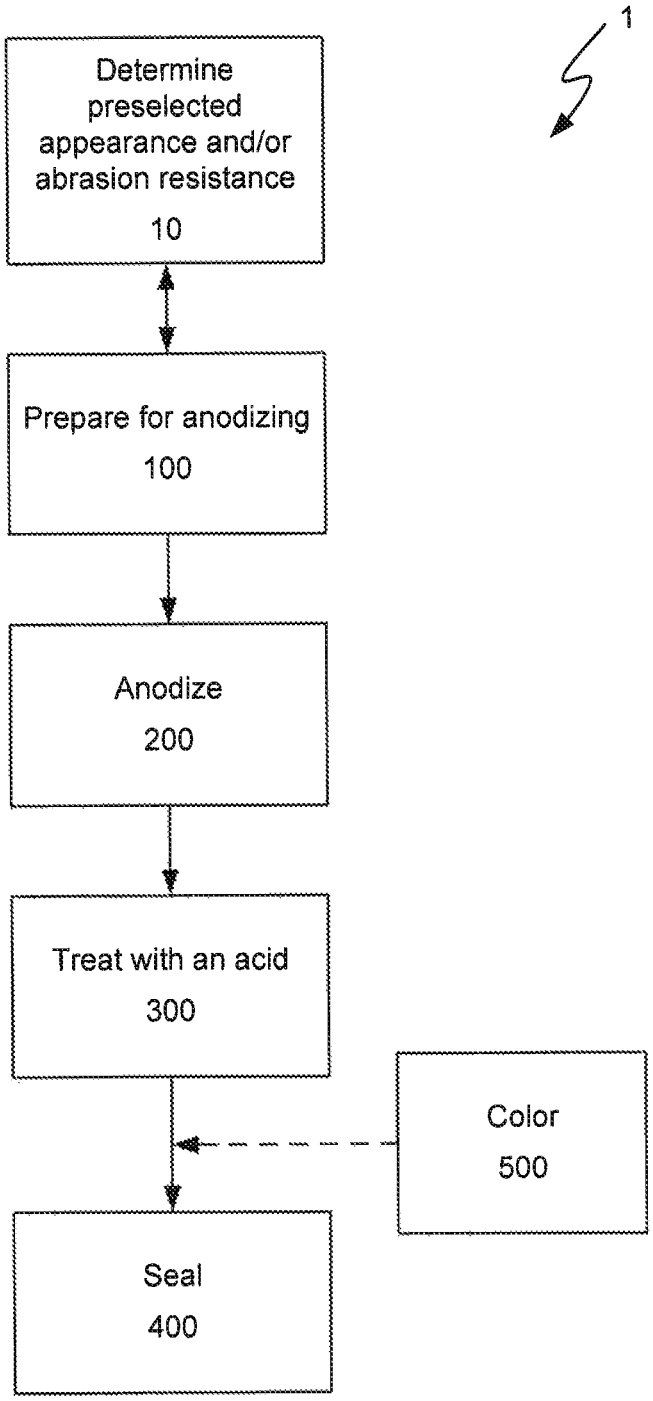
FIG. 1 is a flow chart illustrating one embodiment of a method for producing anodized aluminum alloy products.
Figure 2:
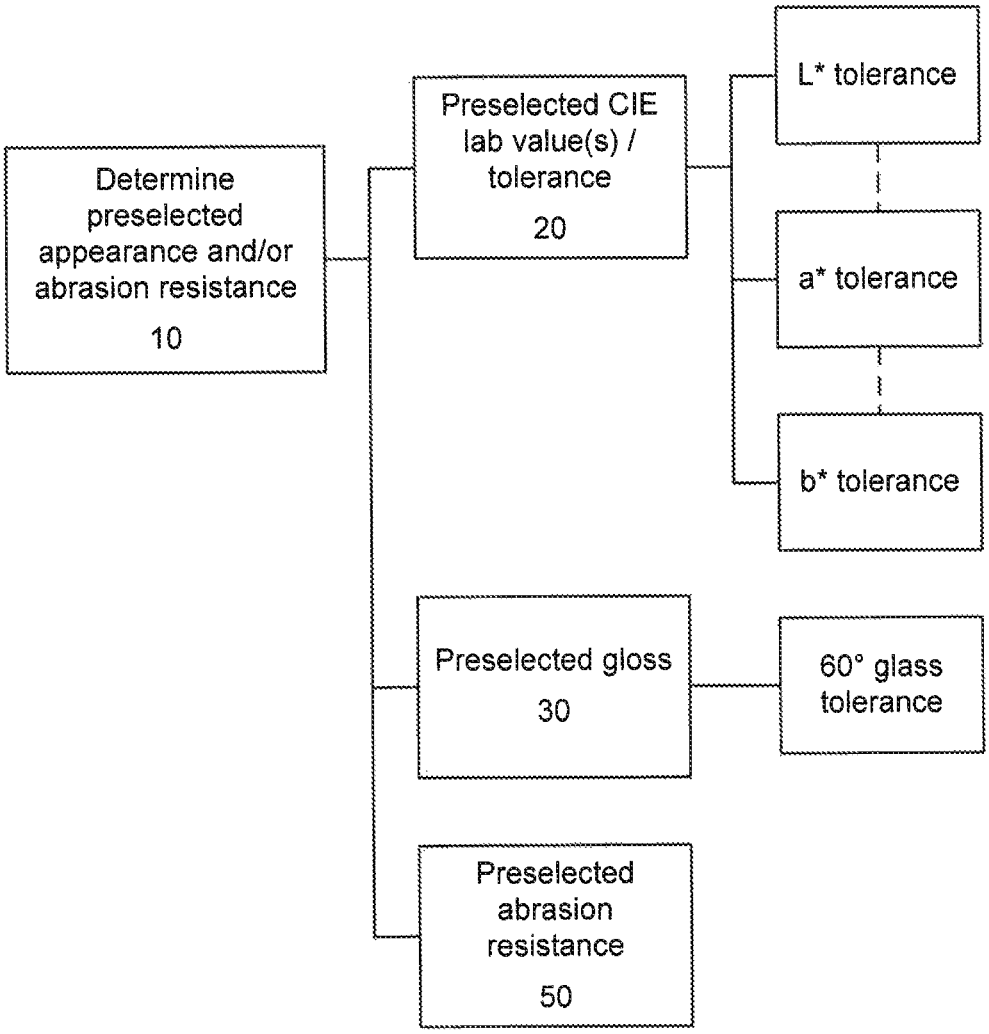
FIG. 2 is a flow chart illustrating some embodiments of the optional determining step (10) of FIG. 1.
Figure 3:
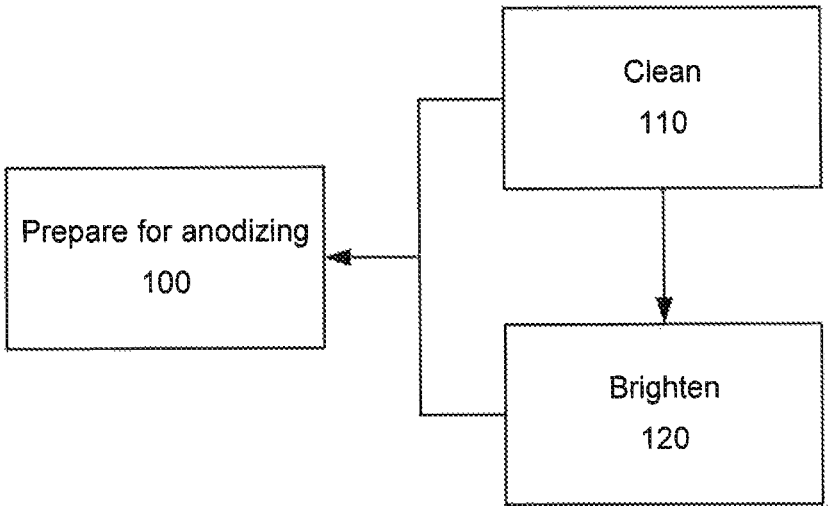
FIG. 3 is a flow chart illustrating some embodiments of the preparing step (100) of FIG. 1.
Figure 4:
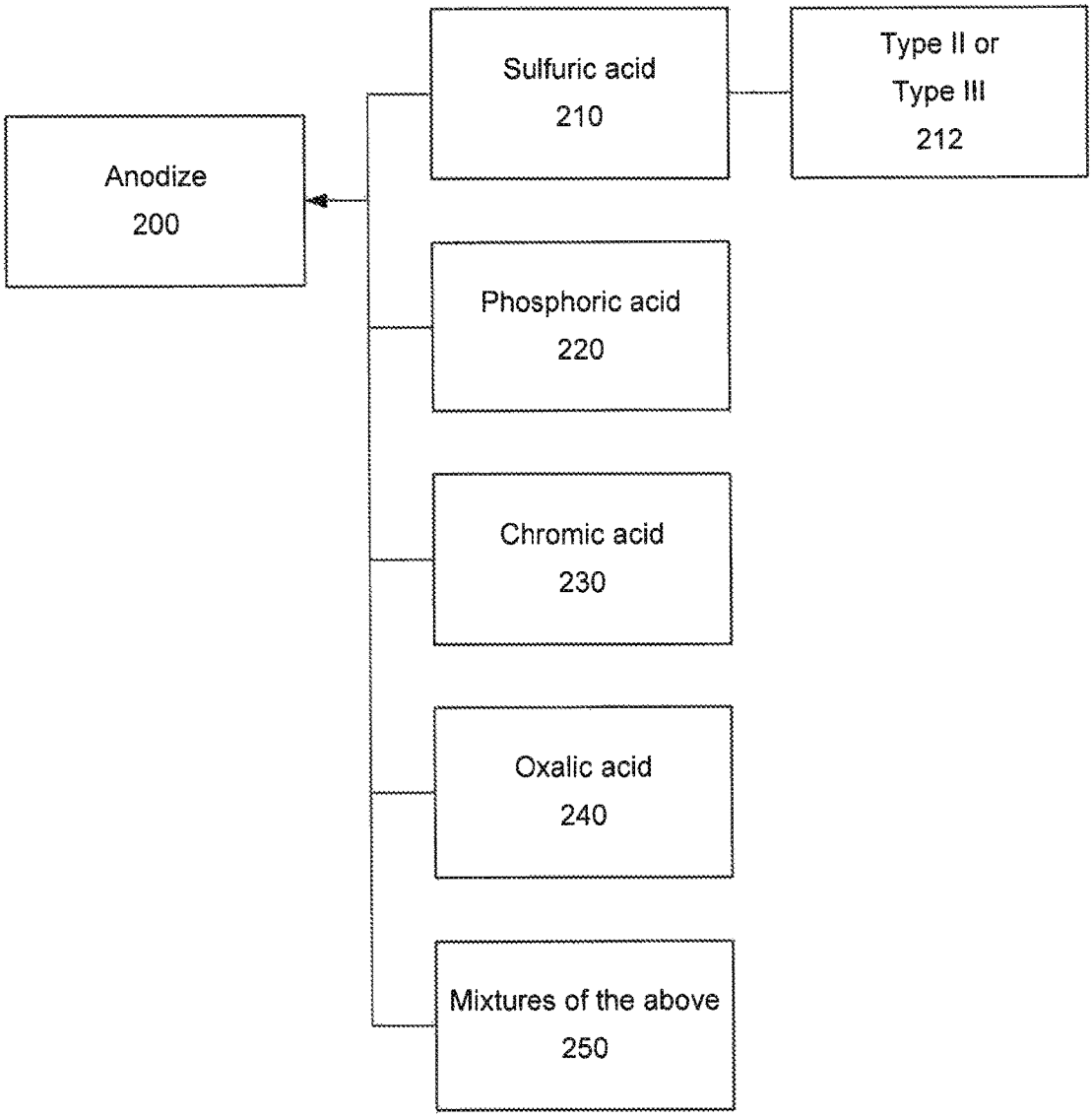
FIG. 4 is a flow chart illustrating some embodiments of the anodizing step (200) of FIG. 1.
Figure 5:
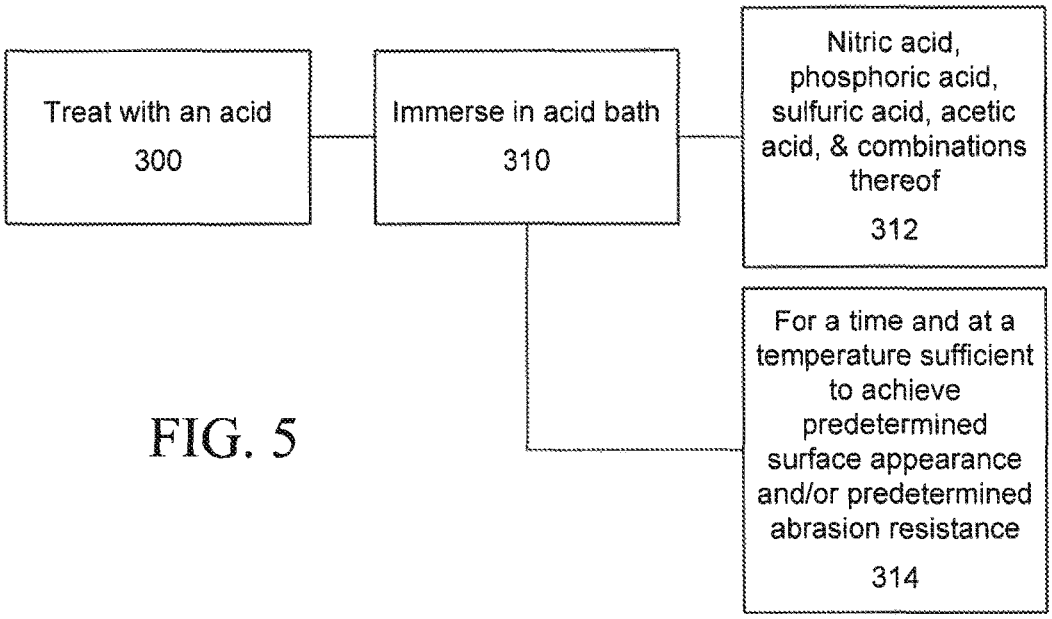
FIG. 5 is a flow chart illustrating some embodiments of the treating step (300) of FIG. 1.
Figure 6:
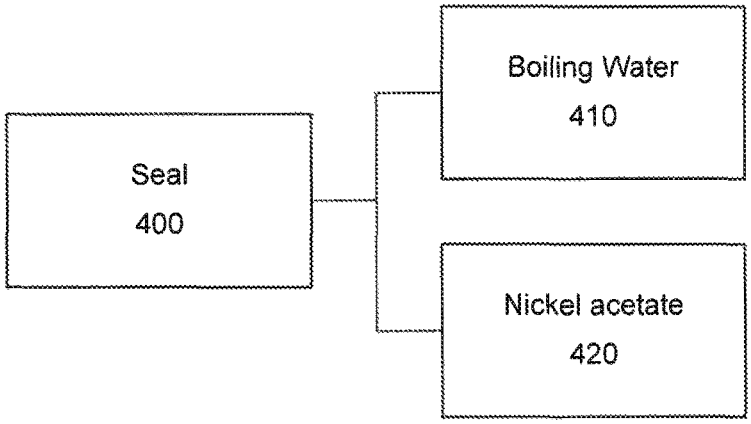
FIG. 6 is a flow chart illustrating some embodiments of the sealing step (400) of FIG. 1.
Figure 7:
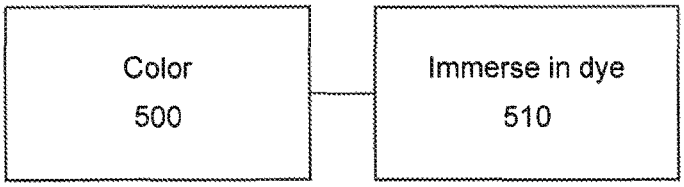
FIG. 7 is a flow chart illustrating some embodiments of the optional coloring step (500) of FIG. 1.
Figure 8A:
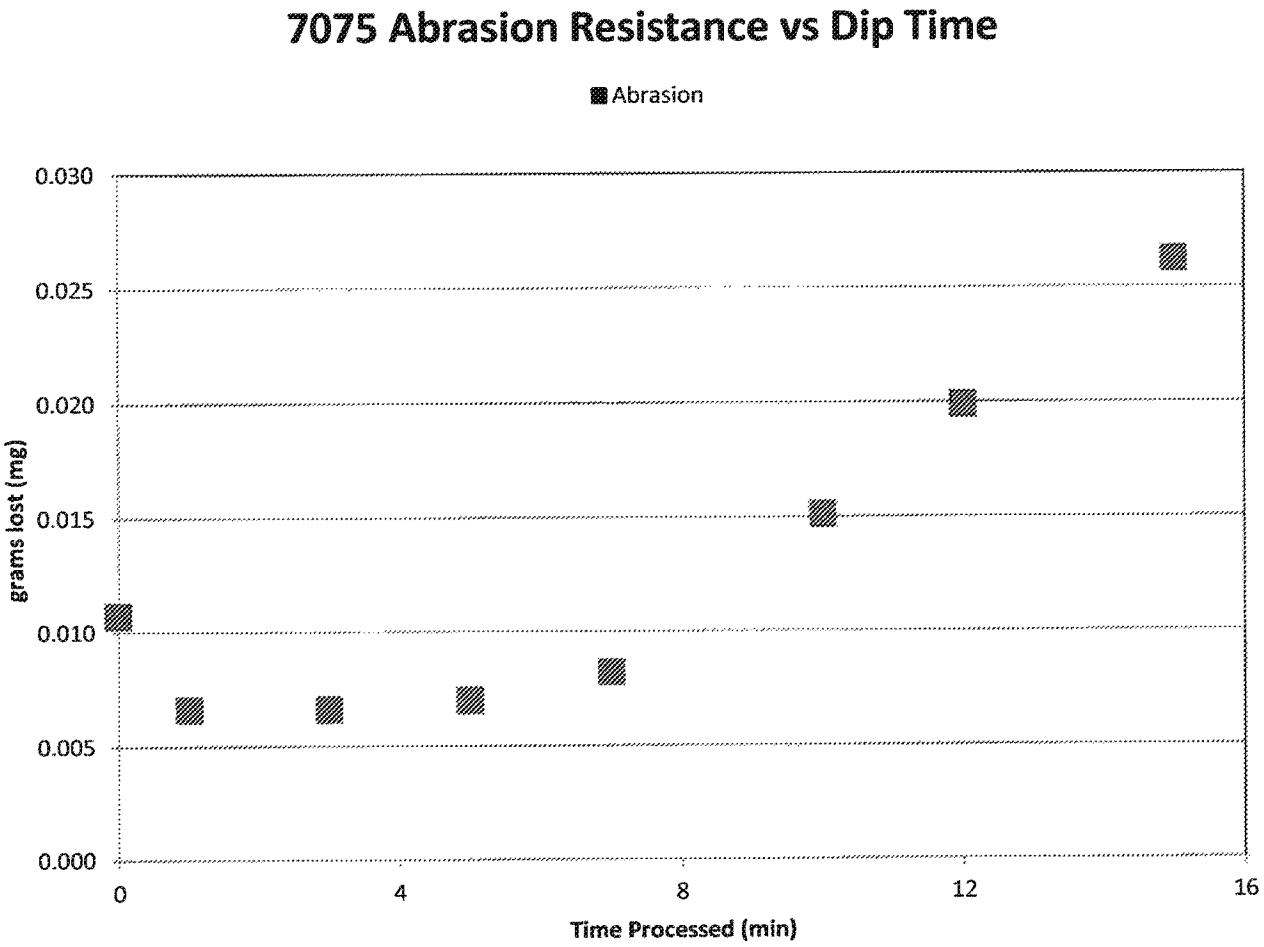
FIGS. 8*a*-8*b* are graphs illustrating characteristics of alloy 7075 as a function of nitric acid dip (contact) time.
Figure 8B:
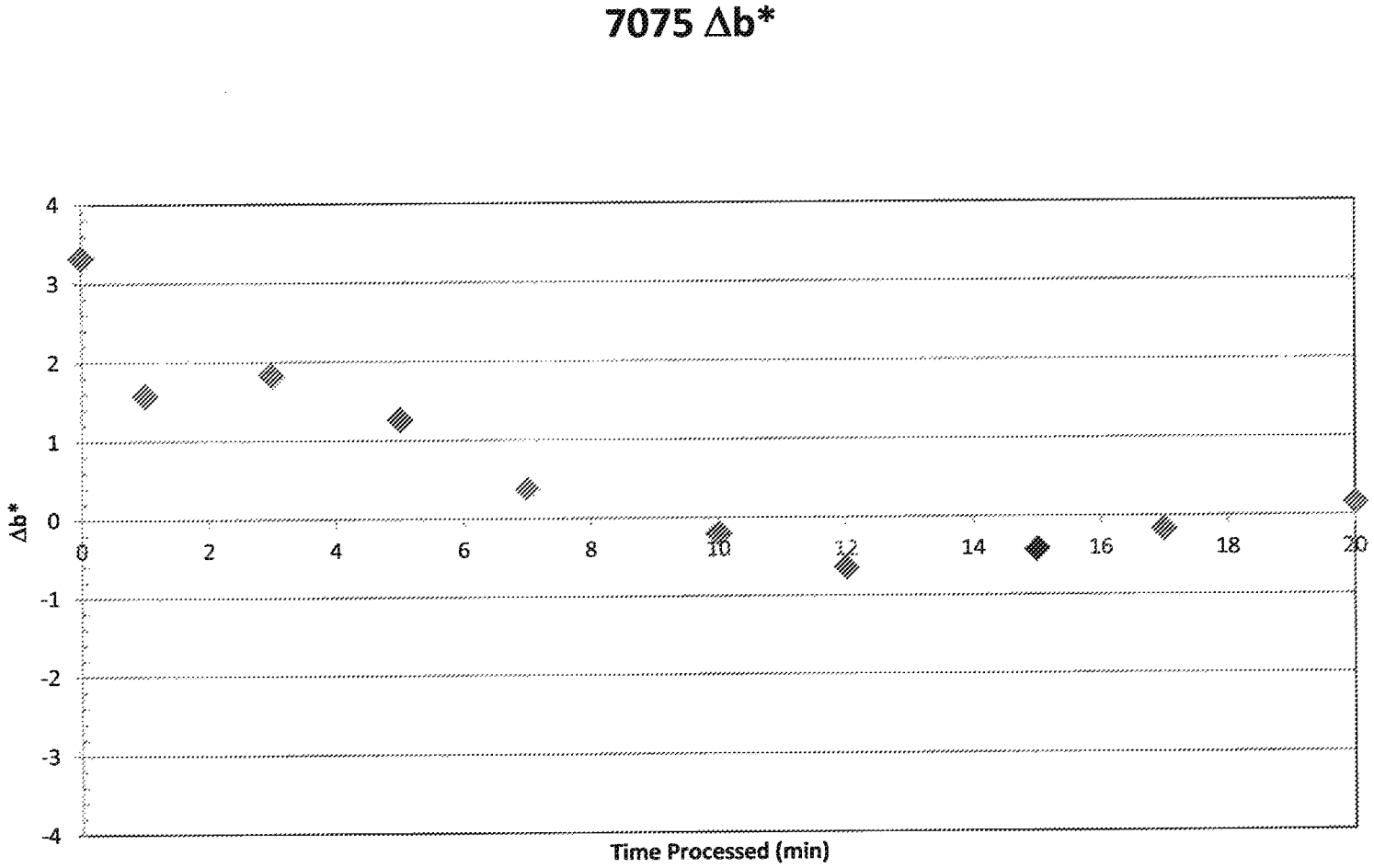

Aluminum alloy 7075 in a T6 temper is produced as a sheet. The sheet is then prepared for anodizing by cleaning, after which it is Type II anodized. The sheet is then dipped in a nitric acid bath (about 33% wt.) for various times and then sealed, after which various b* color measurements and abrasion resistances were measured. No coloring was applied between the nitric acid dip and the sealing. The results are shown in FIGS. 8*a*-8*b*. As shown in FIG. 8*a*, increased dipping times result in lower abrasion resistance. However, as shown in FIG. 8*b*, the specified b* color tolerance cannot be achieved without dipping the nitric acid bath for a suitable period of time. SEM photos of the 7075-T6 samples reveal that some of the particles in the anodic oxide zone had been removed from the anodic oxide zone due to the nitric acid dip, and that the pores of the anodic oxide zone had been enlarged due to the nitric acid dip. Such particle removal and/or pore enlargement may have at least partially facilitated achievement of the preselected b* tolerance.

Example 2

Alloys 1090, 2024, 3103, 5657, and 6061 were processed similar to the processes of Example 1. Specifically, these alloys, in sheet form, were prepared for anodizing by cleaning, after which they were Type II anodized. The sheets were then dipped in a nitric acid bath (about 33% wt.) for about 8 minutes, and then sealed, after which each sheets' b* color value was measured. For comparison purposes, these same alloys, as well as alloy 7075, are also conventionally processed and without the nitric acid bath dip step of Example 1, i.e., the sheets were prepared for anodizing, Type II anodized, and then sealed, after which after which each sheets' b* color value was measured. The results are shown in Table 1, below.

TABLE 1

Example 2 - b* values

| Alloy | Process | Total Reflectance | b* |
|---|---|---|---|
| 1090 | Conventional | 86.0 | 0.27 |
| 1090 | Post-anodizing acid dip | 85.9 | −1.10 |
| 2024 | Conventional | 73.6 | 0.12 |
| 2024 | Post-anodizing acid dip | 75.5 | −0.66 |
| 3103 | Conventional | 68.2 | 1.15 |
| 3103 | Post-anodizing acid dip | 69.6 | 0.42 |
| 5657 | Conventional | 84.8 | 0.24 |
| 5657 | Post-anodizing acid dip | 84.7 | 0.42 |
| 6061 | Conventional | 73.7 | −1.98 |
| 6061 | Post-anodizing acid dip | 73.9 | −2.40 |
| 7075 | Conventional | 65.2 | −0.65 |
| 7075 | Post-anodizing acid dip | 70.4 | −3.79 |

All of the alloys, except alloy 5657, realize a less "yellow" appearance when using the new post-anodizing treatment step. This is shown by the b* values decreasing relative to the conventionally processed version of that alloy. Reflectance is also generally improved when using the new post-anodizing treatment step. The gloss and surface roughness of the samples processed according to the new process were comparable to the gloss and surface roughness of the samples processed according to the conventional process.

Example 3

Alloy 7055 in sheet form is processed similar to the 7075 alloy of Example 1. Specifically, the 7055 sheet is prepared for anodizing by cleaning, after which it is Type II anodized. The sheet is then dipped in a nitric acid bath (about 33% wt.) for various times and then sealed, after which various b* values were measured. The results are shown in FIG. 9. Again, as with Example 1, the specified b* color tolerance cannot be achieved without exposing the anodized product to the nitric acid bath for a sufficient period of time. Also, as shown, prolonged exposure may result in deteriorating results.

Example 4

Alloys 2024, 6013 and 7075 in sheet form were prepared for anodizing by alkaline cleaning for 2 minutes at 150° F., chemical polishing for 1 minute at 200° F., and a 1-minute nitric acid desmut (with intermediate water rinses), and then Type II anodized at 12 ASF, 70° F. for 10 minutes in a 20% by weight sulfuric acid electrolyte. The oxide thickness was then measured and ranged from about 0.23 to 0.30 mil (about 5.8 to 7.6 microns). A control sample (reference-version) of each of the alloys was then prepared by sealing the alloy in boiling water. The b* value of each control sample was then measured. Other portions of the alloys were then dipped in nitric acid baths for various times, at various bath temperatures, and at various nitric acid concentrations, and then sealed, after which b* color and oxide thickness were measured. Δb* was then calculated relative to the control sample, and oxide thickness loss (if any) was also calculated. The results are provided in Tables 2-4 below.

TABLE 2

Example 4 - Alloy 2024 Results

| Nitric Acid Conc.** | Nitric Acid Bath Temp. (° F.) | Exposure Time (minutes) | Δb* versus Std. 2024 (sealed) | Oxide Thickness Change (mil) |
|---|---|---|---|---|
| 50% | 60 | 1 | −0.35 | — |
| 50% | 60 | 3 | −0.44 | — |
| 50% | 60 | 5 | −0.35 | — |
| 50% | 60 | 7 | −0.44 | — |
| 50% | 60 | 10 | −0.34 | — |
| 50% | 60 | 15 | −0.12 | — |
| 50% | 60 | 20 | −0.98 | — |
| 50% | 80 | 1 | −0.39 | — |
| 50% | 80 | 3 | −0.34 | — |
| 50% | 80 | 5 | −0.40 | — |
| 50% | 80 | 7 | −1.19 | — |
| 50% | 80 | 10 | 0.57 | — |
| 50% | 80 | 15 | −2.63 | — |
| 50% | 80 | 20 | −3.37 | 0.06 |
| 50% | 95 | 1 | −0.51 | — |
| 50% | 95 | 3 | −0.08 | — |
| 50% | 95 | 5 | −1.89 | 0.08 |
| 50% | 95 | 7 | 0.59 | 0.12 |
| 50% | 95 | 10 | 0.82 | 0.13 |
| 50% | 95 | 15 | −0.93 | 0.20 |
| 50% | 95 | 20 | −5.55 | 0.20 |
| 50% | 110 | 1 | −0.44 | 0.06 |
| 50% | 110 | 3 | −2.26 | 0.08 |
| 50% | 110 | 5 | −1.36 | 0.16 |
| 50% | 110 | 7 | −2.53 | 0.18 |
| 50% | 110 | 10 | −3.11 | 0.21 |
| 50% | 110 | 15 | −1.64 | 0.22 |
| 50% | 110 | 20 | −1.42 | 0.23 |
| 10% | 80 | 10 | −0.54 | — |
| 25% | 80 | 10 | −0.53 | — |
| 75% | 80 | 10 | −0.99 | — |
| 100% | 80 | 10 | −0.54 | 0.08 |

TABLE 3

Example 4 - Alloy 6013 Results

| Nitric Acid Conc.** | Nitric Acid Bath Temp. (° F.) | Exposure Time (minutes) | Δb* versus Std. 6013 (sealed) | Oxide Thickness Change (mil) |
|---|---|---|---|---|
| 50% | 60 | 1 | −0.70 | — |
| 50% | 60 | 3 | −0.04 | — |
| 50% | 60 | 5 | −0.14 | — |
| 50% | 60 | 7 | −0.04 | — |
| 50% | 60 | 10 | −0.21 | — |
| 50% | 60 | 15 | −0.05 | — |
| 50% | 60 | 20 | −0.58 | — |
| 50% | 80 | 1 | −0.44 | — |
| 50% | 80 | 3 | −0.44 | — |
| 50% | 80 | 5 | −0.58 | — |
| 50% | 80 | 7 | −0.58 | — |
| 50% | 80 | 10 | −0.49 | — |
| 50% | 80 | 15 | −0.06 | — |
| 50% | 80 | 20 | −0.48 | — |
| 50% | 95 | 1 | −0.47 | — |
| 50% | 95 | 3 | −0.58 | — |
| 50% | 95 | 5 | −0.63 | — |
| 50% | 95 | 7 | −0.21 | — |
| 50% | 95 | 10 | −0.74 | — |
| 50% | 95 | 15 | −1.29 | — |
| 50% | 95 | 20 | 0.53 | — |
| 50% | 110 | 1 | −0.67 | — |
| 50% | 110 | 3 | −0.27 | — |
| 50% | 110 | 5 | −0.29 | — |
| 50% | 110 | 7 | −0.02 | — |
| 50% | 110 | 10 | 0 | — |
| 50% | 110 | 15 | −2.86 | 0.17 |
| 50% | 110 | 20 | −1.93 | 0.18 |
| 10% | 80 | 10 | −0.49 | — |
| 25% | 80 | 10 | −0.60 | — |
| 75% | 80 | 10 | −0.53 | — |
| 100% | 80 | 10 | −0.10 | 0.10 |

TABLE 4

Example 4 - Alloy 7075 Results

| Nitric Acid Conc.** | Nitric Acid Bath Temp. (° F.) | Exposure Time (minutes) | Δb* versus Std. 7075 (sealed) | Oxide Thickness Change (mil) |
|---|---|---|---|---|
| 50% | 60 | 1 | −0.53 | — |
| 50% | 60 | 3 | −0.80 | — |
| 50% | 60 | 5 | −0.90 | — |
| 50% | 60 | 7 | −1.08 | — |
| 50% | 60 | 10 | −1.18 | — |
| 50% | 60 | 15 | −1.11 | — |
| 50% | 60 | 20 | −1.64 | — |
| 50% | 80 | 1 | −1.46 | — |
| 50% | 80 | 3 | −1.88 | — |
| 50% | 80 | 5 | −2.66 | — |
| 50% | 80 | 7 | −2.76 | — |
| 50% | 80 | 10 | −1.27 | — |
| 50% | 80 | 15 | −0.95 | — |
| 50% | 80 | 20 | −0.85 | — |
| 50% | 95 | 1 | −1.03 | — |
| 50% | 95 | 3 | −1.83 | — |
| 50% | 95 | 5 | −1.34 | — |
| 50% | 95 | 7 | −1.55 | — |
| 50% | 95 | 10 | −0.58 | 0.08 |
| 50% | 95 | 15 | −2.17 | 0.17 |
| 50% | 95 | 20 | −0.83 | 0.22 |
| 50% | 110 | 1 | −1.99 | — |
| 50% | 110 | 3 | −2.46 | — |
| 50% | 110 | 5 | −0.47 | 0.02 |
| 50% | 110 | 7 | −8.32 | 0.20 |
| 50% | 110 | 10 | −5.87 | 0.21 |
| 50% | 110 | 15 | −4.61 | 0.23 |
| 50% | 110 | 20 | −3.02 | 0.24 |
| 10% | 80 | 10 | −2.42 | — |
| 25% | 80 | 10 | −2.44 | — |

TABLE 4-continued

| Example 4 - Alloy 7075 Results | | | | |
|---|---|---|---|---|
| Nitric Acid Conc.** | Nitric Acid Bath Temp. (° F.) | Exposure Time (minutes) | Δb* versus Std. 7075 (sealed) | Oxide Thickness Change (mil) |
| 75% | 80 | 10 | −2.38 | — |
| 100% | 80 | 10 | −1.75 | 0.09 |

**The nitric acid concentration is the volume percent of the fully concentrated version of nitric acid (67 wt. %).

As shown above and in FIGS. 10-13, all alloys processed at 60° F. achieved no oxide loss, irrespective of exposure duration. Alloy 2024, however did experience oxide loss at higher temperatures. Alloy 6013 was the most tolerant of bath temperature and exposure time. These results indicate that the bath temperature may vary from about 60° F. (or lower) to 110° F. (or higher), depending on alloy composition and bath exposure time.

As shown in FIGS. 14-16, for the alloys that did not realize an oxide thickness change, the alloys achieved lower b* values as compared to the control sample, meaning that the alloys realize a less "yellow" appearance when using the new post-anodizing treatment dip step.

As shown in FIG. 17, various concentrations of nitric acid can also be used to achieve a decrease in b* values. Pure nitric acid treatments realized some oxide loss, but it is anticipated that pure nitric acid could be used in circumstances where lower temperatures and/or lower exposure times are utilized.

Example 5

Alloy 7075 in sheet form was prepared for anodizing by as per Example 4 and then Type II anodized per Example 4, but producing an anodic oxide zone thickness of approximately 0.40 to 0.45 mil (about 10.2 microns to about 11.4 microns). A control sample (reference-version) of the alloy was then prepared by sealing the alloy in boiling water. The b* value of the control sample was then measured. Other portions of the alloy were then dipped in various chemical solutions, at various bath temperatures, and at various concentrations, and then sealed, after which b* color, and oxide thickness were measured. Δb* was then calculated relative to the control sample, and oxide thickness was also calculated. No oxide loss resulted in any of these tests. The results are provided in Table 5, below.

TABLE 5

| Example 5 Results | | | |
|---|---|---|---|
| Chemical | Exposure Time (min.) | Bath temp (° F.) | Δb* |
| 5% (vol.?) acetic | 8 | 80 | −0.11 |
| 5% (vol.?) acetic | 3 | 80 | −0.07 |
| 50 vol. % Nitric Acid (relative to fully concentrated) | 3 | 80 | −0.98 |
| 50% Nitric Acid (relative to fully concentrated) | 2 | 80 | −0.76 |
| 50% Nitric Acid (relative to fully concentrated) | 1 | 80 | −0.38 |
| 30% by vol DI water + 30% by vol HNO3 (from 68-70% con) + 10% by vol H3PO4 (from 85% con) + 30% by vol H2SO4 (from 98% con) | 3 | 70 | −2.29 |
| 30% by vol DI water + | 2 | 70 | −1.71 |

TABLE 5-continued

| Example 5 Results | | | |
|---|---|---|---|
| Chemical | Exposure Time (min.) | Bath temp (° F.) | Δb* |
| 30% by vol HNO3 (from 68-70% con) + 10% by vol H3PO4 (from 85% con) + 30% by vol H2SO4 (from 98% con) | | | |
| 30% by vol DI water + 30% by vol HNO3 (from 68-70% con) + 10% by vol H3PO4 (from 85% con) + 30% by vol H2SO4 (from 98% con) | 1 | 70 | −1.11 |
| 5% (vol.) of an 85% H3PO4 sol. in DI water | 3 | 80 | −5.17 |
| 5% Nitric Acid + 5% Acetic Acid (vol.) | 9 | 80 | −1.77 |
| 5% Nitric Acid + 5% Acetic Acid (vol.) | 6 | 80 | −1.19 |
| 5% Nitric Acid + 5% Acetic Acid (vol.) | 3 | 80 | −0.63 |
| Anodal Deox LFN diluted to 6% (vol.) | 3 | 80 | −3.42 |
| Anodal Deox LFN diluted to 6% (vol.) | 2 | 80 | −3.11 |
| Anodal Deox LFN diluted to 6% (vol.) | 1 | 80 | −2.64 |

"LFN" means ANODAL Deox LFN Liquid from Reliant Aluminum Products, LLC, 520 Townsend Ave., High Point, N.C. 2726. As shown above, all of the chemicals lower the b* values as compared to the control sample (reference-version), meaning that the alloys realize a less "yellow" appearance when using the new post-anodizing treatment dip step. These results indicate that any of nitric acid, phosphoric acid, acetic acid, sulfuric acid, and combinations thereof may be used as a post-anodizing solution to reduce "yellowness" of an anodized aluminum alloy.

While various embodiments of the new technology described herein have been described in detail, it is apparent that modifications and adaptations of those embodiments will occur to those skilled in the art. However, it is to be expressly understood that such modifications and adaptations are within the spirit and scope of the presently disclosed technology.

The invention claimed is:

1. A method comprising:

(a) preparing an aluminum alloy body for anodizing, wherein the aluminum alloy is a 2xxx, a 5xxx, a 6xxx, or a 7xxx aluminum alloy;

(b) anodizing the aluminum alloy body, thereby producing an anodized aluminum alloy body having an anodic oxide zone;

(i) wherein the anodizing is selected from the group consisting of type II anodizing, type III anodizing, and combinations thereof;

(c) contacting an intended viewing surface of the anodized aluminum alloy body with an acid to decrease the yellowness of the anodized aluminum alloy body, thereby producing a prepared intended viewing surface of the anodized aluminum alloy body;

(i) wherein the acid is selected from the group consisting of nitric acid, phosphoric acid, acetic acid, sulfuric acid, and mixtures thereof;

(ii) wherein the contacting occurs for a time of from 1 minute to 60 minutes;

(iii) wherein the contacting occurs at a temperature of from 40° F. to 110° F.;

(iv) wherein, when the acid is the nitric acid, the concentration of the nitric acid is from 0.67 wt. % to 67 wt. %; and (d) sealing, via a sealing solution, the prepared intended viewing surface of the anodized aluminum alloy body, wherein the sealing solution is free of colorants, and wherein the method excludes coloring of the anodic oxide zone via dyes;

wherein the method comprises pre-selecting an abrasion resistance tolerance for the intended viewing surface of the aluminum alloy body; and wherein the contacting step is completed such that the intended viewing surface of the aluminum alloy body achieves the pre-selected abrasion resistance tolerance.

2. The method of claim 1, comprising:

determining a preselected color tolerance of the intended viewing surface of the aluminum alloy body;

wherein the contacting step is completed such that the intended viewing surface of the aluminum alloy body achieves the preselected color tolerance.

3. A method comprising:

(a) preparing an aluminum alloy body for anodizing, wherein the aluminum alloy is a 2xxx, a 5xxx, a 6xxx, or a 7xxx aluminum alloy;

(b) anodizing the aluminum alloy body, thereby producing an anodized aluminum alloy body having an anodic oxide zone;

(i) wherein the anodizing is selected from the group consisting of type II anodizing, type III anodizing, and combinations thereof;

(c) determining a preselected color tolerance of an intended viewing surface of the aluminum alloy body;

(i) wherein the preselected color tolerance comprises a target b* value;

(d) contacting the intended viewing surface of the anodized aluminum alloy body with an acid to decrease the yellowness of the anodized aluminum alloy body, thereby producing a prepared intended viewing surface of the anodized aluminum alloy body;

(i) wherein the acid is selected from the group consisting of nitric acid, phosphoric acid, acetic acid, sulfuric acid, and mixtures thereof;

(ii) wherein the contacting occurs for a time of from 1 minute to 60 minutes;

(iii) wherein the contacting occurs at a temperature of from 40° F. to 110° F.;

(iv) wherein, when the acid is the nitric acid, the concentration of the nitric acid is from 0.67 wt. % to 67 wt. %;

(v) wherein the contacting step is completed such that the intended viewing surface of the aluminum alloy body achieves the preselected color tolerance;

(vi) wherein the contacting step is completed such that the intended viewing surface of the aluminum alloy body achieves an actual b* value that is within the 1.0 units of the target b* value; and (e) sealing, via a sealing solution, the prepared intended viewing surface of the anodized aluminum alloy body, wherein the sealing solution is free of colorants, and wherein the method excludes coloring of the anodic oxide zone via dyes.

4. The method of claim 3, wherein the contacting step is completed such that the intended viewing surface of the aluminum alloy body achieves an actual b* value that is within the 0.5 unit of the target b* value.

5. The method of claim 3, wherein the contacting step is completed such that the intended viewing surface of the aluminum alloy body achieves an actual b* value that is within the 0.4 unit of the target b* value.

6. The method of claim 3, wherein the contacting step is completed such that the intended viewing surface of the aluminum alloy body achieves an actual b* value that is within the 0.3 unit of the target b* value.

7. The method of claim 3, wherein the contacting step is completed such that the intended viewing surface of the aluminum alloy body achieves an actual b* value that is within the 0.2 unit of the target b* value.

8. The method of claim 3, wherein the contacting step is completed such that the intended viewing surface of the aluminum alloy body achieves an actual b* value that is within the 0.1 unit of the target b* value.

9. The method of claim 3, wherein the actual b* value is lower than a b* value of a reference-version of the intended viewing surface of the aluminum alloy body in the anodized and then sealed condition.

10. The method of claim 1, wherein, after the anodizing step (b) and before the contacting step (c), the intended viewing surface of the anodized aluminum alloy body has an anodic oxide zone thickness of from 0.07 to 4.5 mil.

11. The method of claim 10, wherein the anodic oxide zone thickness is a pre-contacting anodic oxide zone thickness, wherein the method comprises:

completing the contacting step so as to achieve a final anodic oxide zone thickness that is within 10% of the pre-contacting anodic oxide zone thickness.

12. The method of claim 11, wherein the final anodic oxide zone thickness is within 5% of the pre-contacting anodic oxide zone thickness.

13. The method of claim 11, wherein the final anodic oxide zone thickness is within 3% of the pre-contacting anodic oxide zone thickness.

14. The method of claim 11, wherein the final anodic oxide zone thickness is within 1% of the pre-contacting anodic oxide zone thickness.

15. The method of claim 1, wherein the aluminum alloy has a longitudinal (L) tensile yield strength of at least 275 MPa.

16. The method of claim 15, wherein the aluminum alloy is a 7xxx aluminum alloy.

17. The method of claim 16, wherein the 7xxx aluminum alloy is one of a 7x75, 7x50, 7x55, or 7x85 aluminum alloy.

18. The method of claim 1, wherein the method consists of the stated steps.

19. The method of claim 2, wherein the method consists of the stated steps.

20. A method comprising:

(a) determining a preselected color tolerance of an intended viewing surface of an aluminum alloy body, wherein the aluminum alloy is a 2xxx, a 5xxx, a 6xxx, or a 7xxx aluminum alloy;

(b) preparing the aluminum alloy body for anodizing;

(c) anodizing the aluminum alloy body, thereby producing an anodized aluminum alloy body having an anodic oxide zone;

(i) wherein the anodizing is selected from the group consisting of type II anodizing, type III anodizing, and combinations thereof;

(d) contacting an intended viewing surface of the anodized aluminum alloy body with an acid to decrease the yellowness of the aluminum alloy body, thereby producing a prepared intended viewing surface of the anodized aluminum alloy body, wherein the acid is selected from the group consisting of nitric acid, phosphoric acid, acetic acid, sulfuric acid, and mixtures thereof, and wherein the contacting occurs for a time of from 1 minute to 60 minutes;

(e) sealing, via a sealing solution, the prepared intended viewing surface of the anodized aluminum alloy body;

wherein the sealing solution is free of colorants;

wherein the contacting step is completed such that the intended viewing surface of the aluminum alloy body achieves the preselected color tolerance;

wherein the preselected color tolerance comprises a target b* value, and wherein the contacting step is completed such that the intended viewing surface of the aluminum alloy body achieves an actual b* value that is within the 1.0 units of the target b* value; and wherein the method excludes coloring of the anodic oxide zone via dyes.

21. The method of claim 20, wherein the acid is nitric acid.

22. The method of claim 21, wherein the nitric acid has a concentration of from 0.67% to 67%.

23. The method of claim 21, wherein the nitric acid has a concentration of from 0.67% to 33%.

24. The method of claim 21, wherein the nitric acid has a concentration of from 0.67% to 13.4%.

25. The method of claim 21, wherein the nitric acid has a concentration of from 0.67% to 6.7%.

26. The method of claim 22, wherein the contacting step (d) comprises immersing the anodized aluminum alloy body in a nitric acid bath comprising the nitric acid, wherein the nitric acid bath has a temperature of from 40° to 110° F.

27. The method of claim 26, wherein the nitric acid bath has a temperature of from 60° to 100° F.

28. The method of claim 26, wherein the nitric acid bath has a temperature of from 60° to 95° F.

29. The method of claim 26, wherein the nitric acid bath has a temperature of from 70° to 90° F.

30. The method of claim 26, wherein the aluminum alloy body is a 7xxx aluminum alloy.

31. The method of claim 30, wherein the 7xxx aluminum alloy is one of a 7x75, 7x50, 7x55, or 7x85 aluminum alloy.

32. The method of claim 1, wherein the contacting occurs for at least 3 minutes.

33. The method of claim 1, wherein the anodic oxide zone comprises particles therein, and wherein the contacting step comprises removing at least some of the particles contained within the anodic oxide zone via the acid.

34. The method of claim 33, wherein the contacting step comprises enlarging pores of the anodic oxide zone.

35. The method of claim 20, wherein the contacting occurs for at least 3 minutes.

36. The method of claim 20, wherein the anodic oxide zone comprises particles therein, and wherein the contacting step comprises removing at least some of the particles contained within the anodic oxide zone via the acid.

37. The method of claim 36, wherein the contacting step comprises enlarging pores of the anodic oxide zone.

* * * * *